United States Patent [19]

Hills

[11] 3,968,604

[45] July 13, 1976

[54] ERECTABLE SHELTER STRUCTURE AND METHOD OF ERECTION

[75] Inventor: James F. Hills, Marietta, Ga.

[73] Assignee: Lockheed Aircraft Corporation, Burbank, Calif.

[22] Filed: Aug. 2, 1974

[21] Appl. No.: 494,350

[52] U.S. Cl. ..... 52/86; 52/745

[51] Int. Cl.[2] ..... E04B 1/35; E04G 21/00

[58] Field of Search ..... 52/86, 127, 72, 66, 52/122, 741, 745, 747, 742

[56] References Cited

UNITED STATES PATENTS 3,572,002 3/1971 Nichols ..... 52/86

*Primary Examiner*—J. Karl Bell

*Attorney, Agent, or Firm*—Billy G. Corber; A. L. Carter

[57] ABSTRACT

A portable, relocatable, erectable building or shelter structure, and method of erecting, utilizing a pair of laterally spaced elongated and segmented base rail assemblies to which are pivotally connected a pair of erectable arch assemblies for each row of a plurality of panels slidably engageable along two opposite sides to each pair of adjacent erectable arch assemblies pivotally connected to the base rail assemblies. The opposite sides of the individual panels other than the panel sides engageable to the adjacent base pivotally connected erectable arch assemblies are configured such as to be sealingly interengageable with the adjacent panel on both sides. The sliding engagement of each row of panels to both adjacent erectable arch assemblies pivotally connected to the base rail assemblies (and when in their vertical positions) constitutes structural retention of such vertical arch assemblies in their substantially upright positions without additional locking devices notwithstanding their pivotal connections to the base rail assemblies, and yet results in a portable erectable shelter or overhead cover structure that is closed and sealed to the elements without additional sealing means or efforts beyond the mere assembly of panels and erectable arches.

The interengaging assembly and relationships between the erectable arch assemblies and panels permits erection of this structure without necessitating absolute ground levelling between the laterally spaced base rail assemblies, as well as without absolute ground levelling throughout the longitudinal lengths of the base rail assemblies. Likewise, the physical engagement and relationships between the erectable arch assemblies and panel member components accomplishes assembly and erection without the necessity for any erection personnel being above ground or base rail level.

One embodiment of an end closure for the building arrangement is shown consisting of a fabric door and hanger construction which is also mountable to the end arch assemblies at ground level before erection. Also, there is shown a side entry door arrangement that can be attached to the erected structure by replacement of two panel members.

28 Claims, 46 Drawing Figures

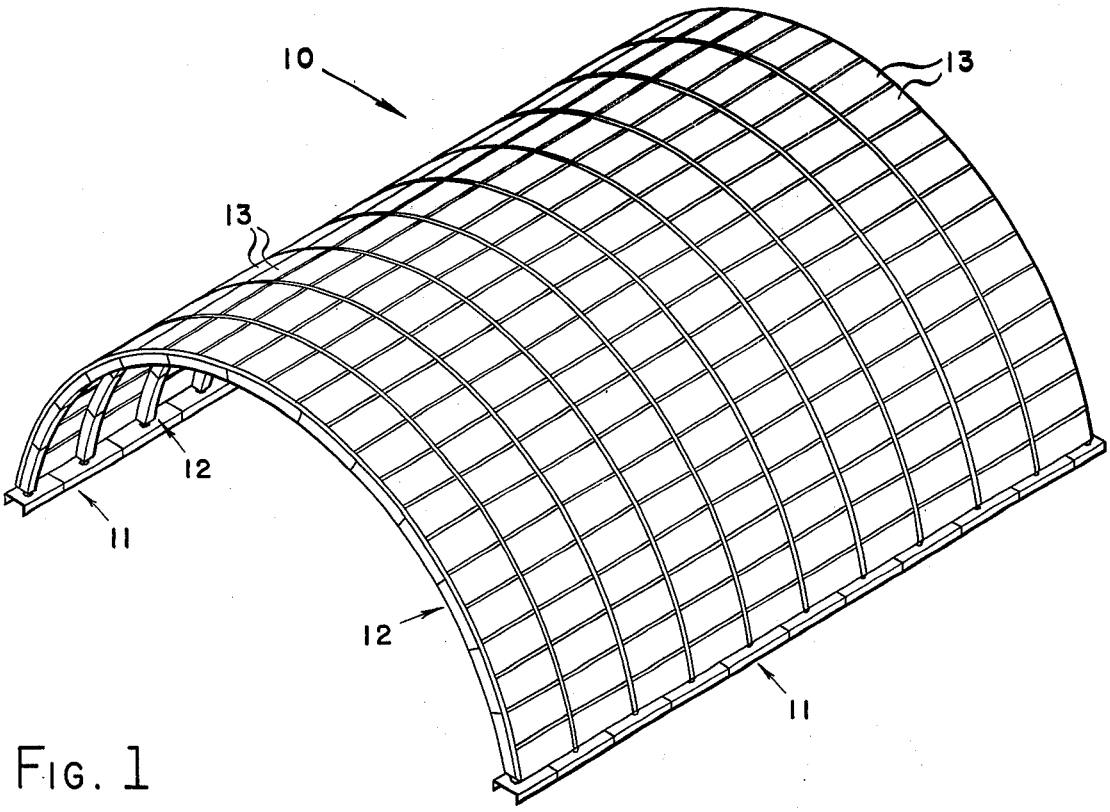
FIG. 1
FIG. 2
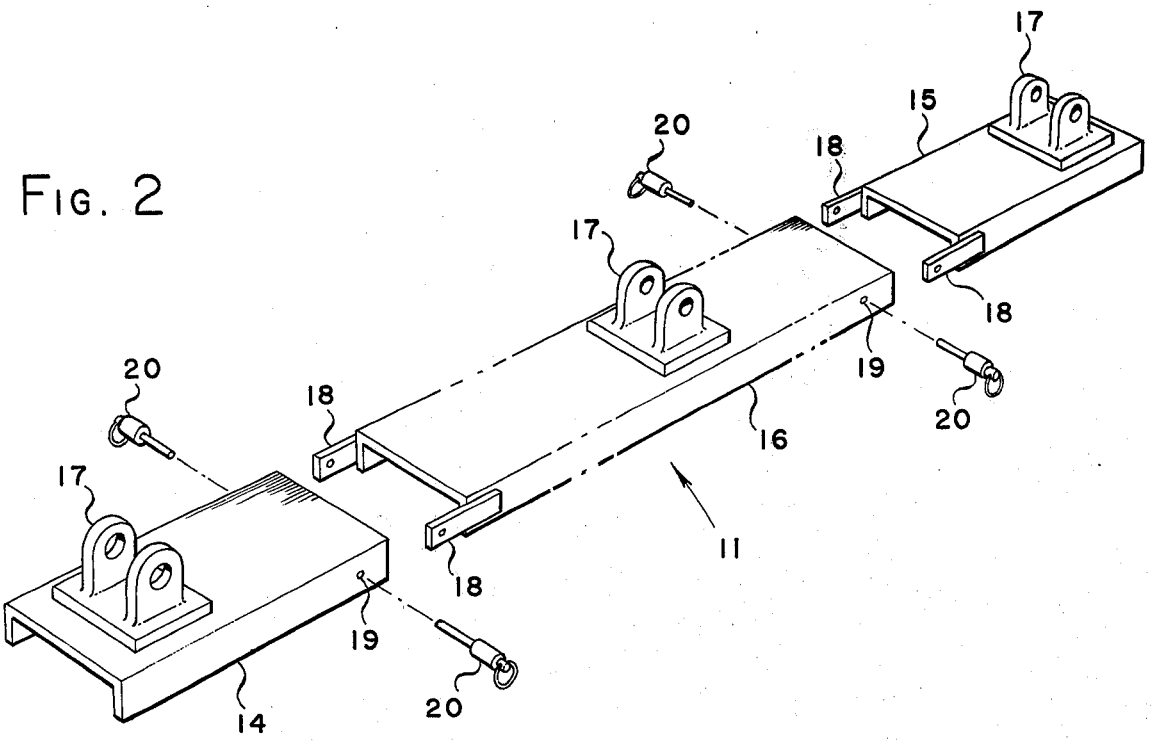

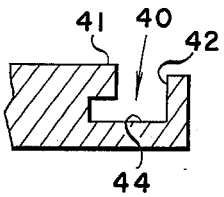
FIG. 6
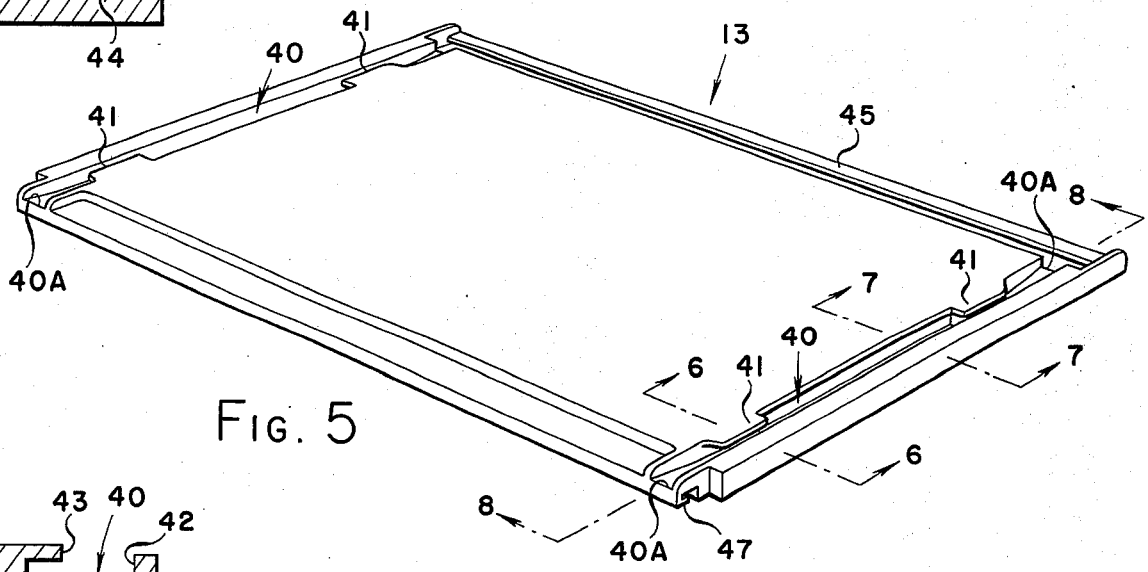
FIG. 5
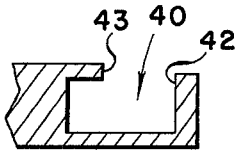
FIG. 7
FIG. 8
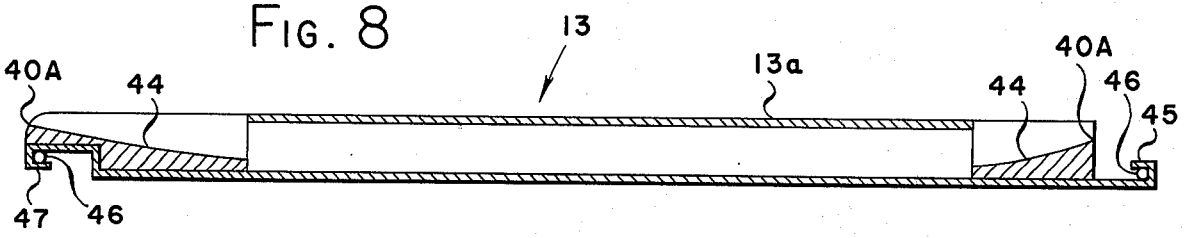
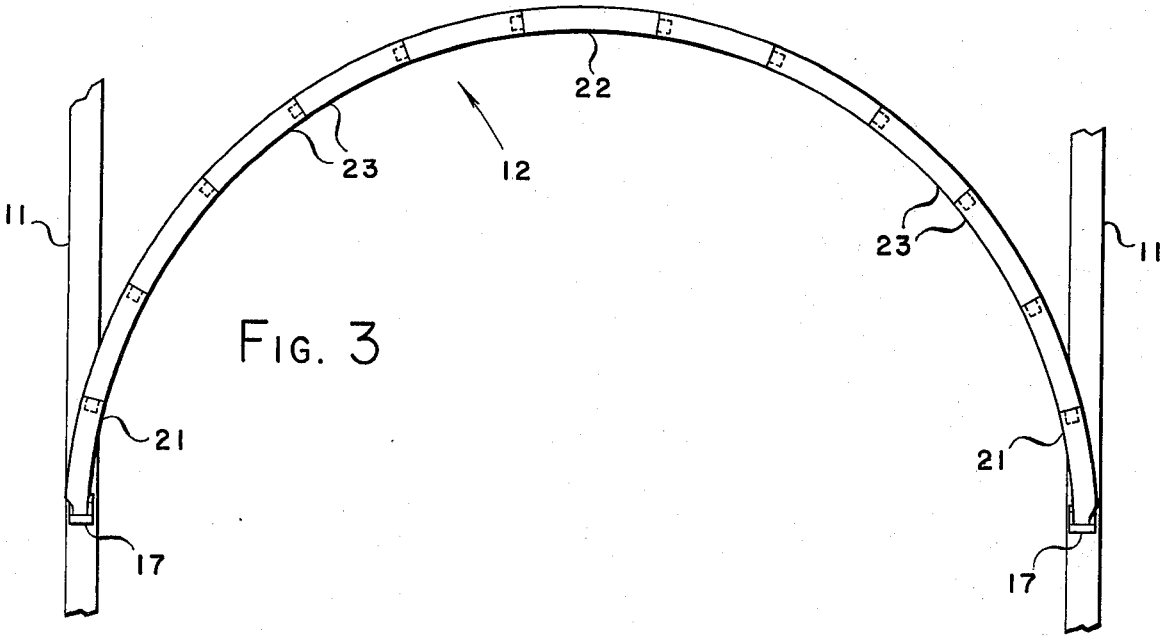
FIG. 3

FIG. 3A
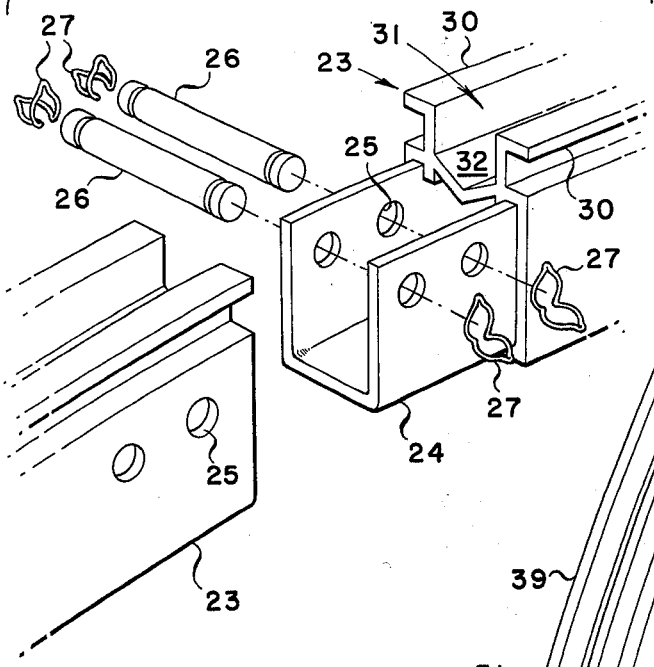
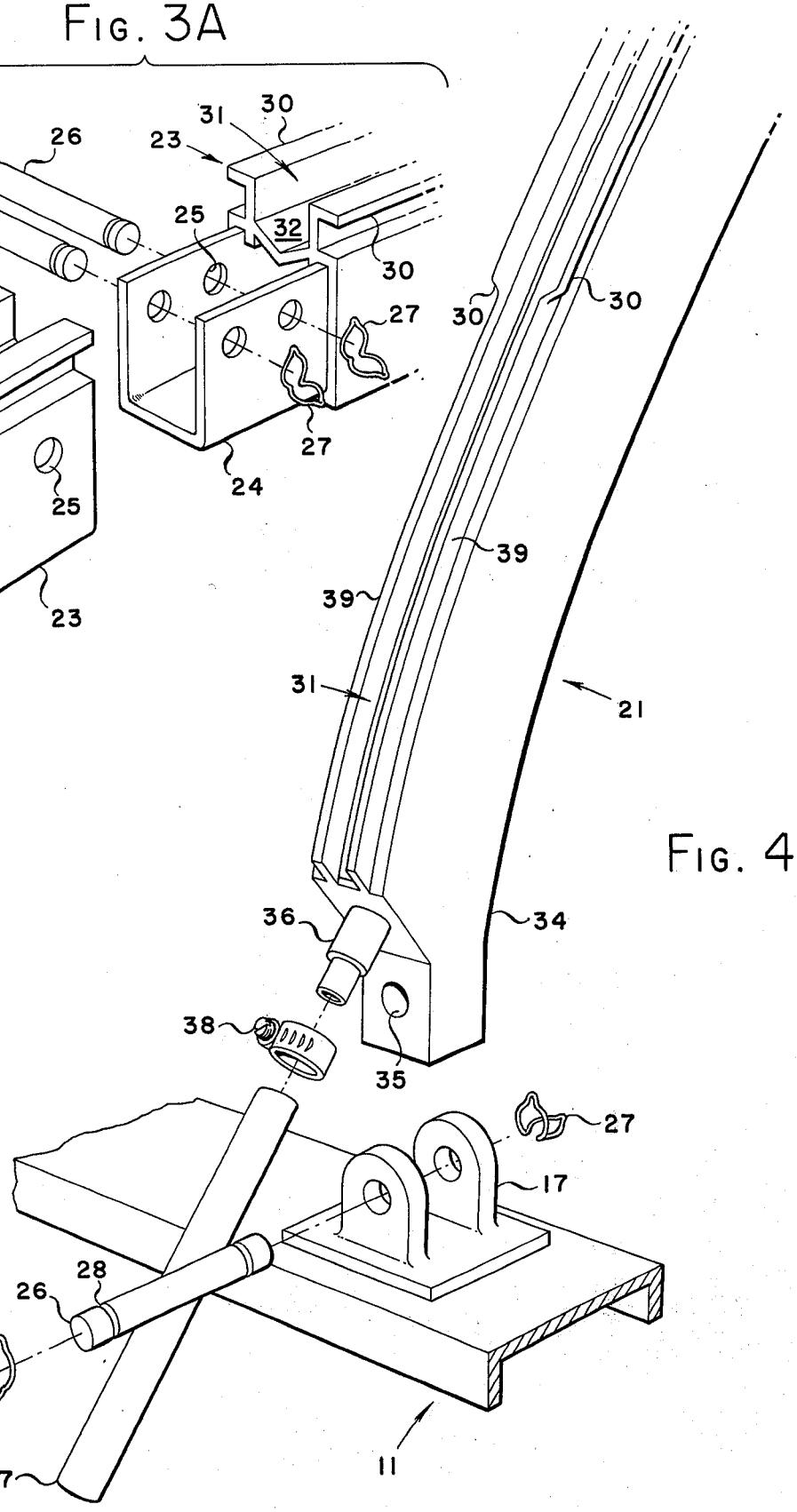
FIG. 4

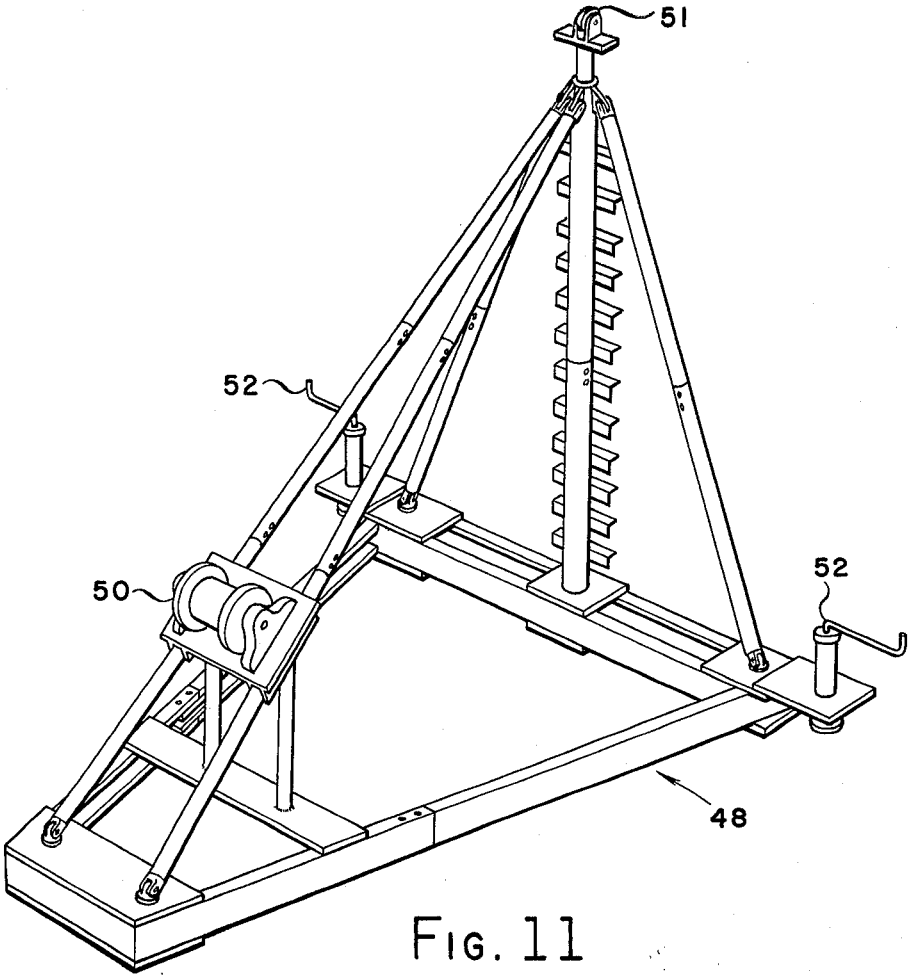
FIG. 11
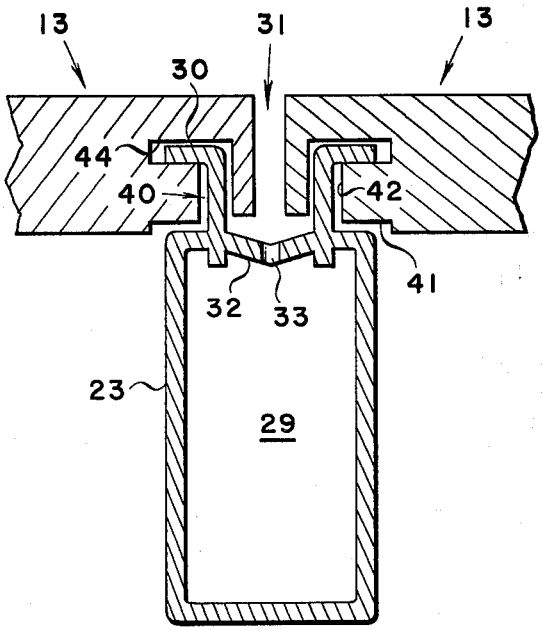
FIG. 9
FIG. 10
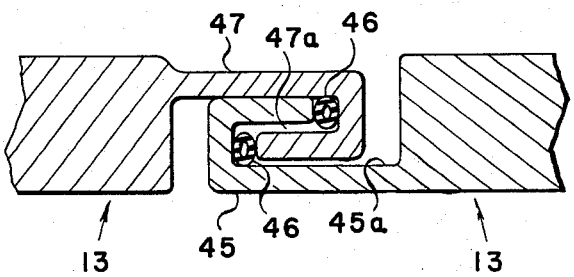

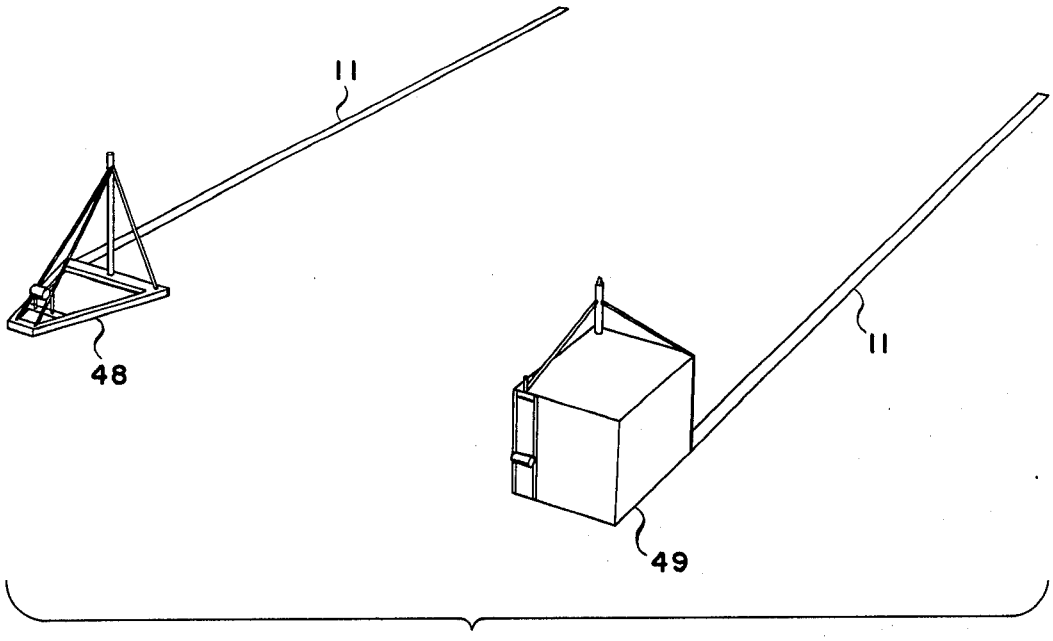
FIG. 13A
FIG. 13B
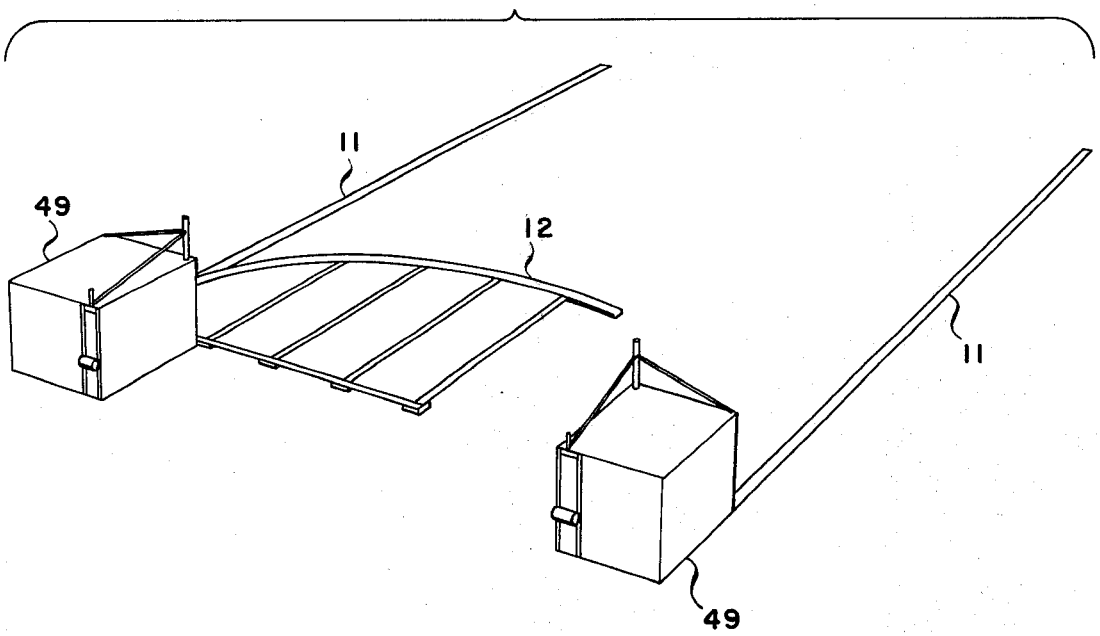

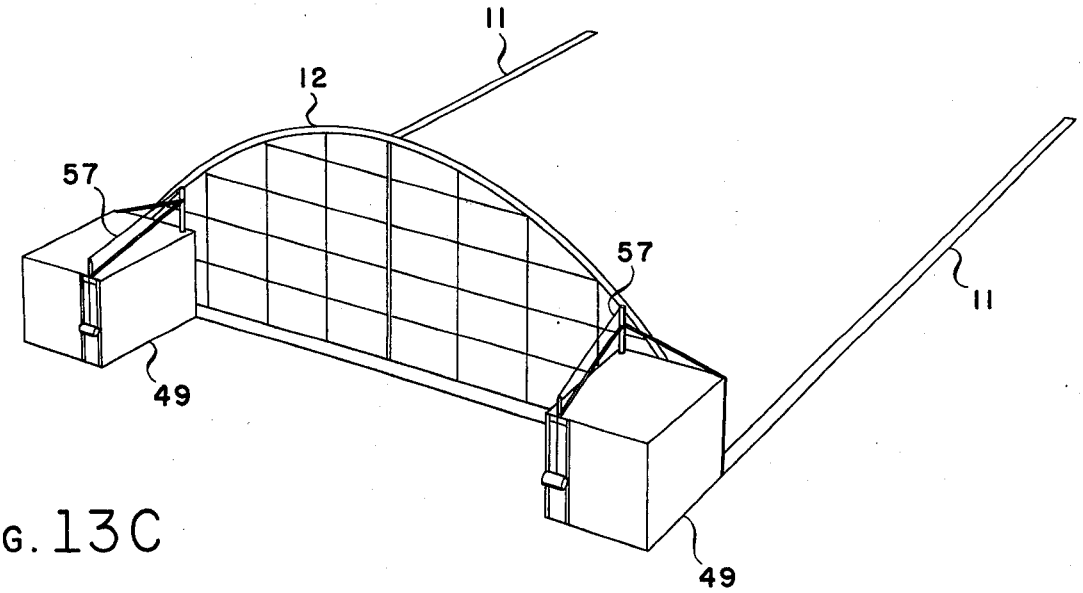
FIG. 13C
FIG. 13D
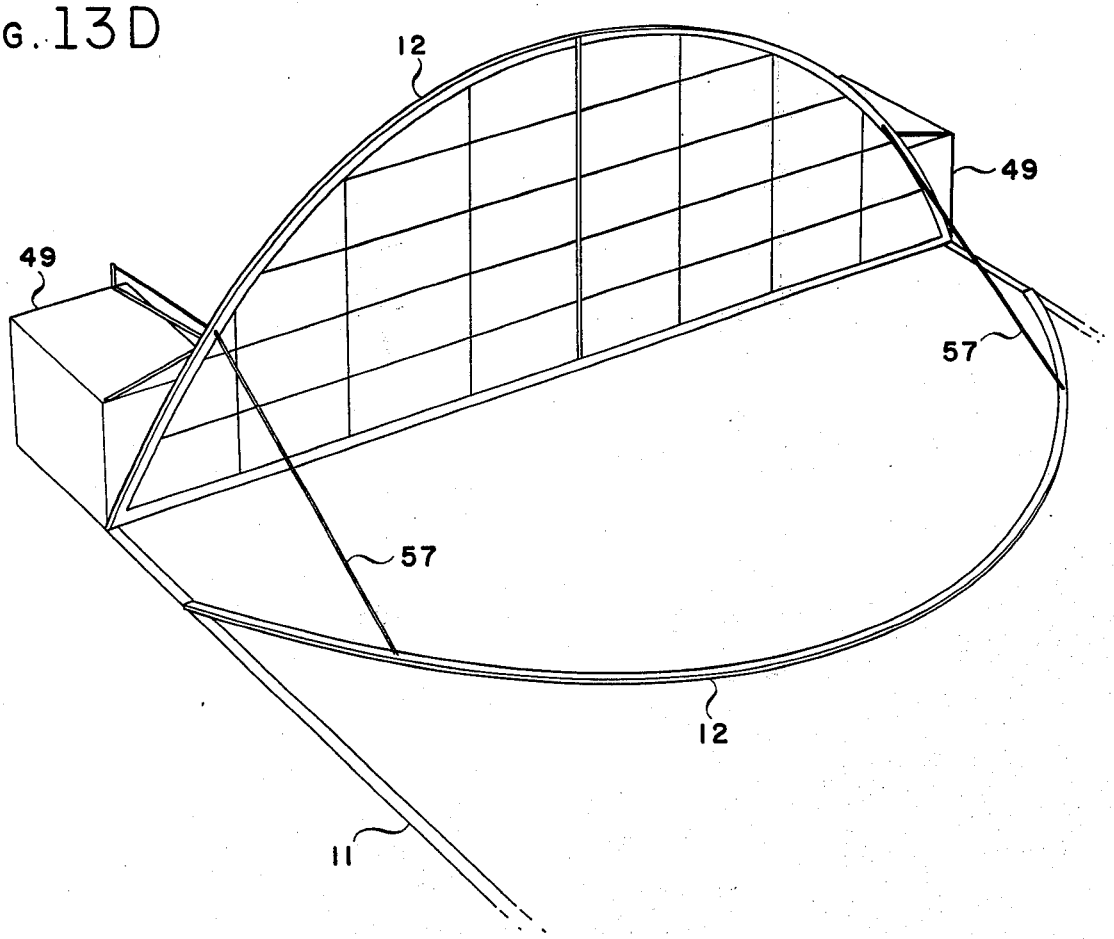

FIG. 13 E
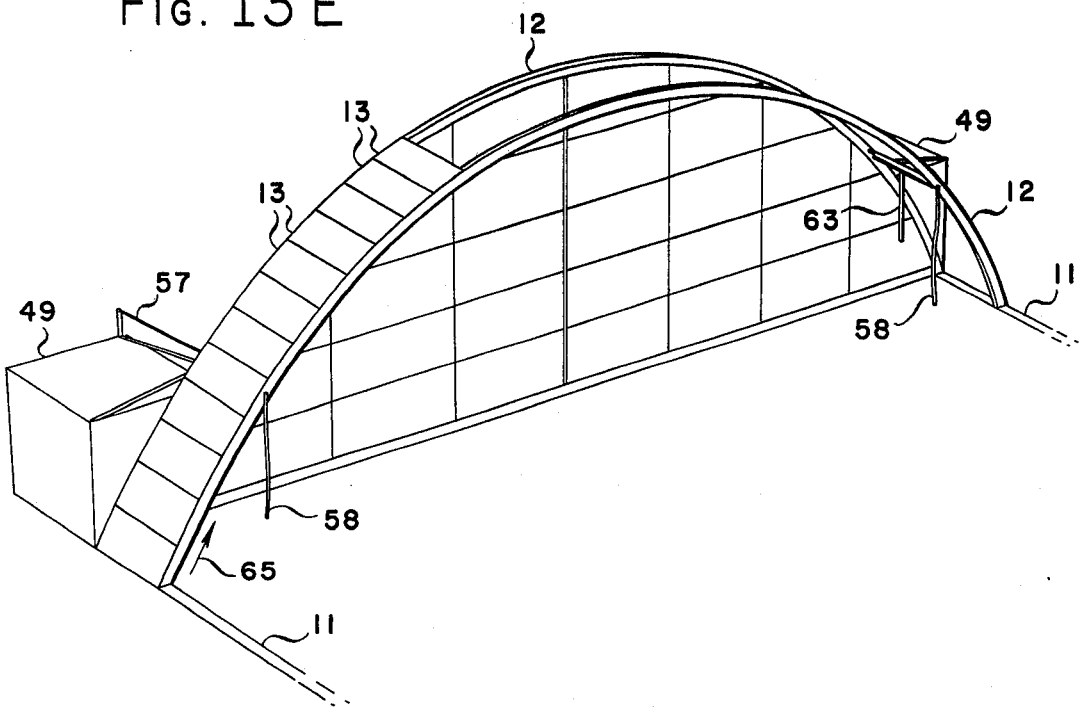
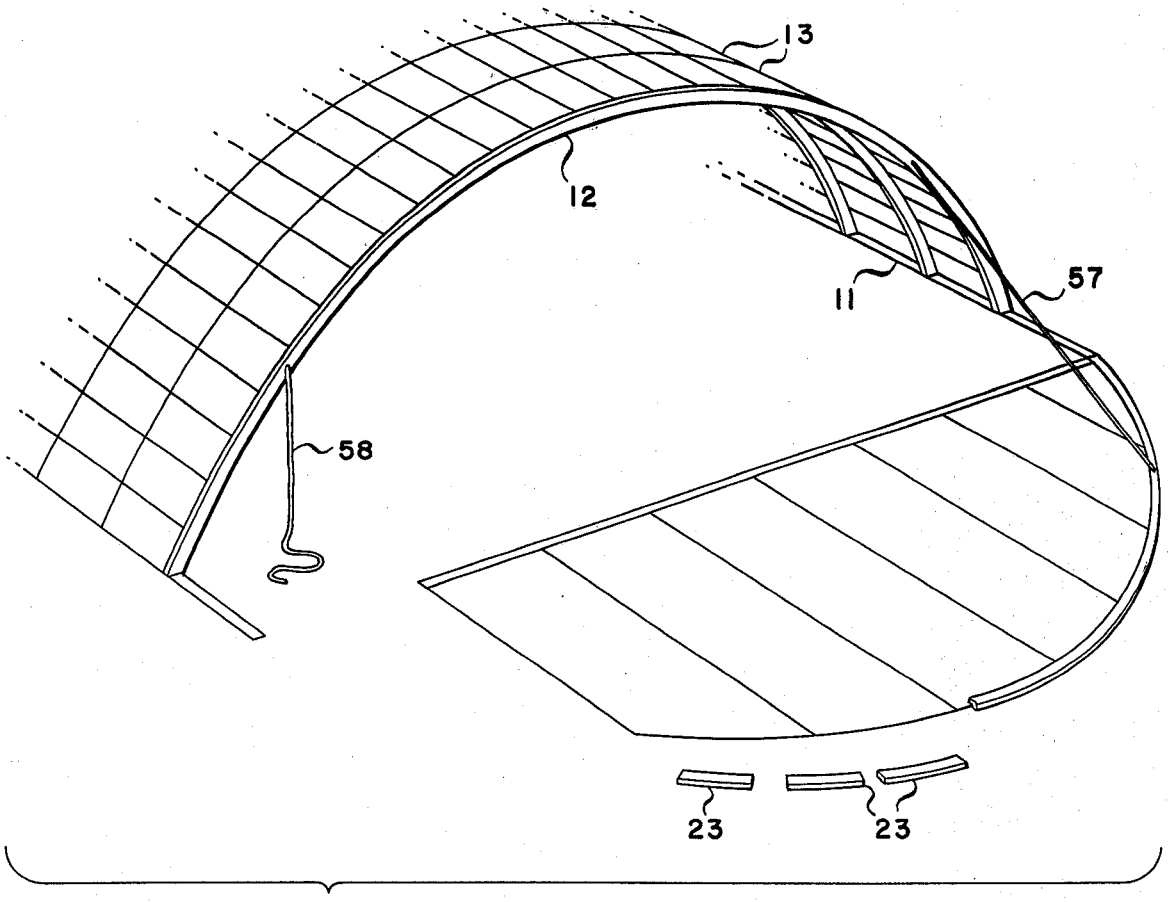
FIG. 13 F

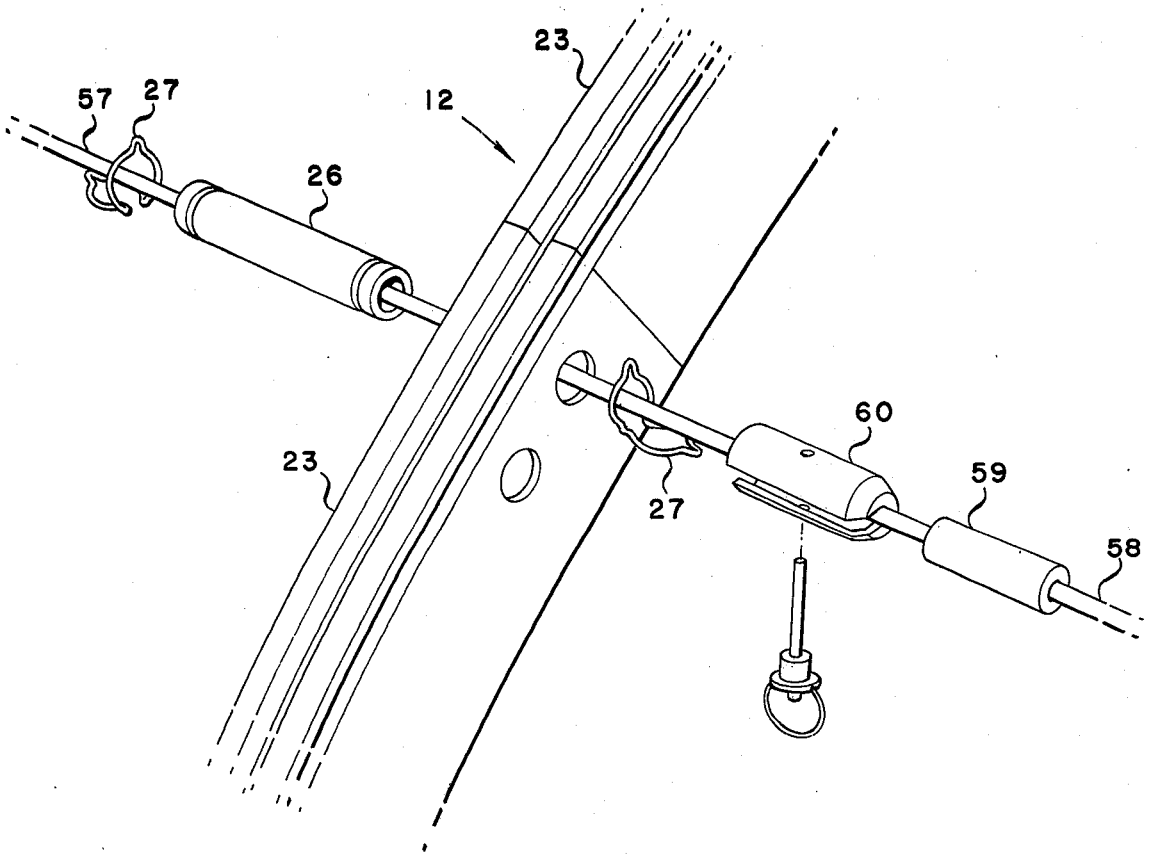
FIG. 13G
FIG. 13H
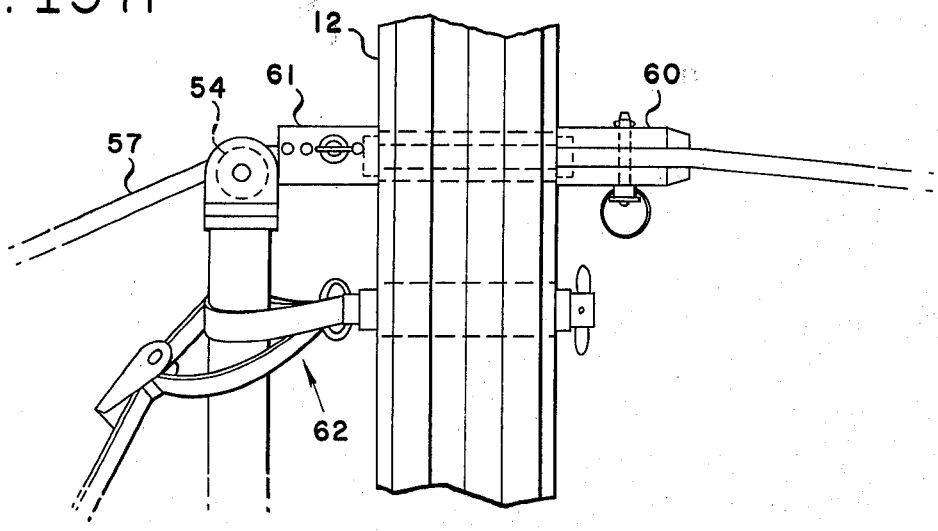

FIG. 14
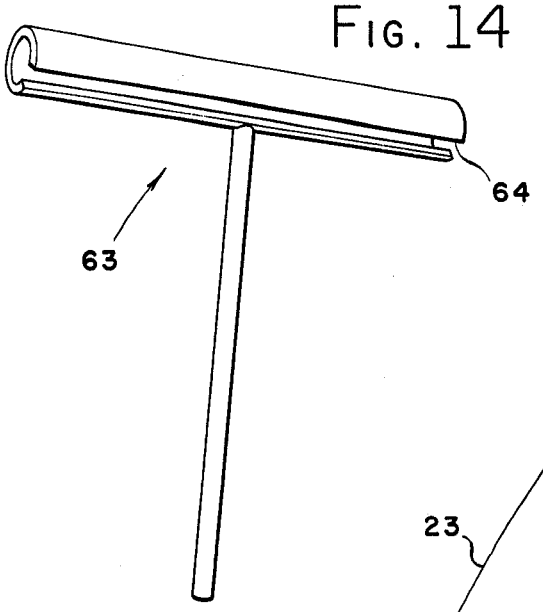
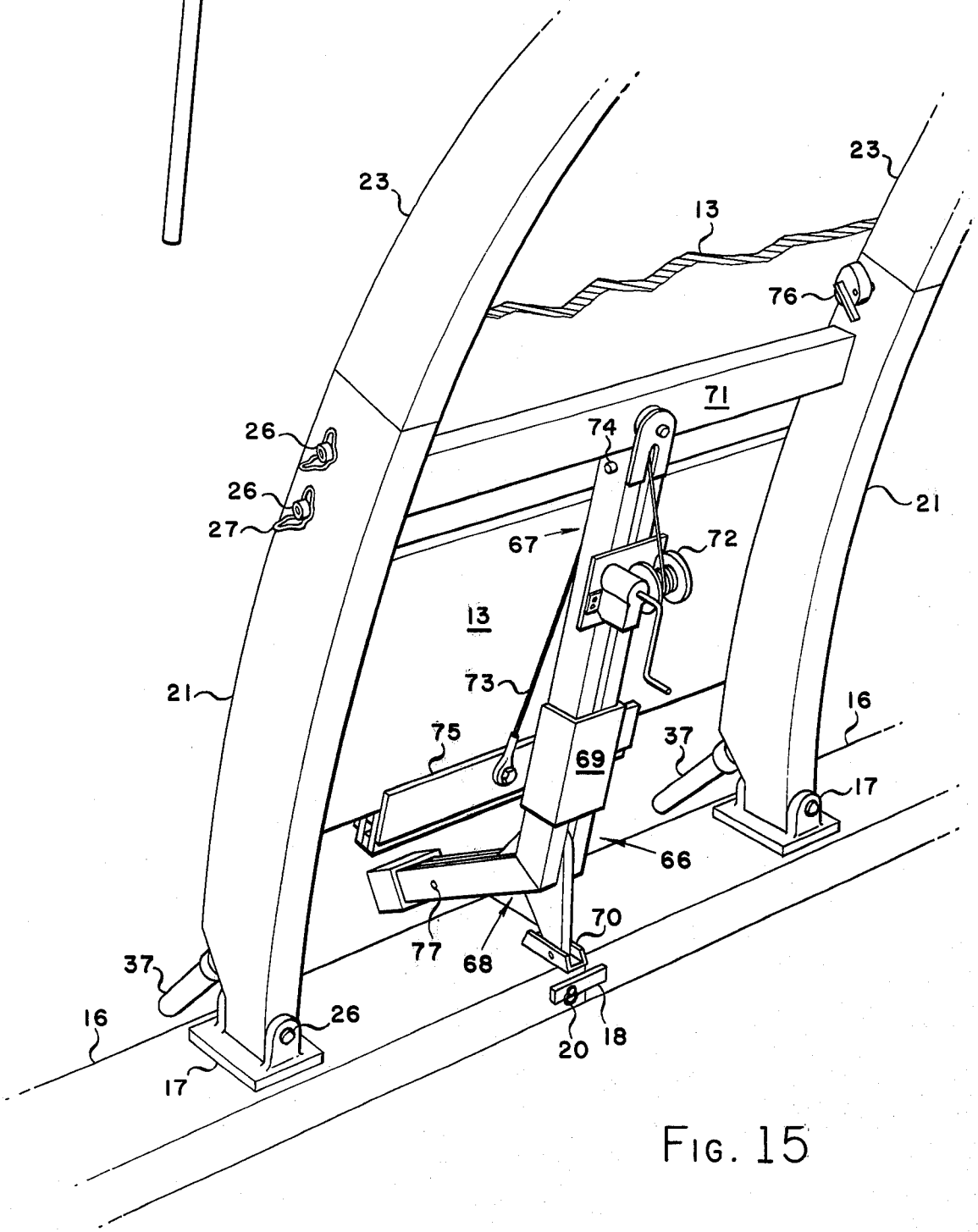
FIG. 15

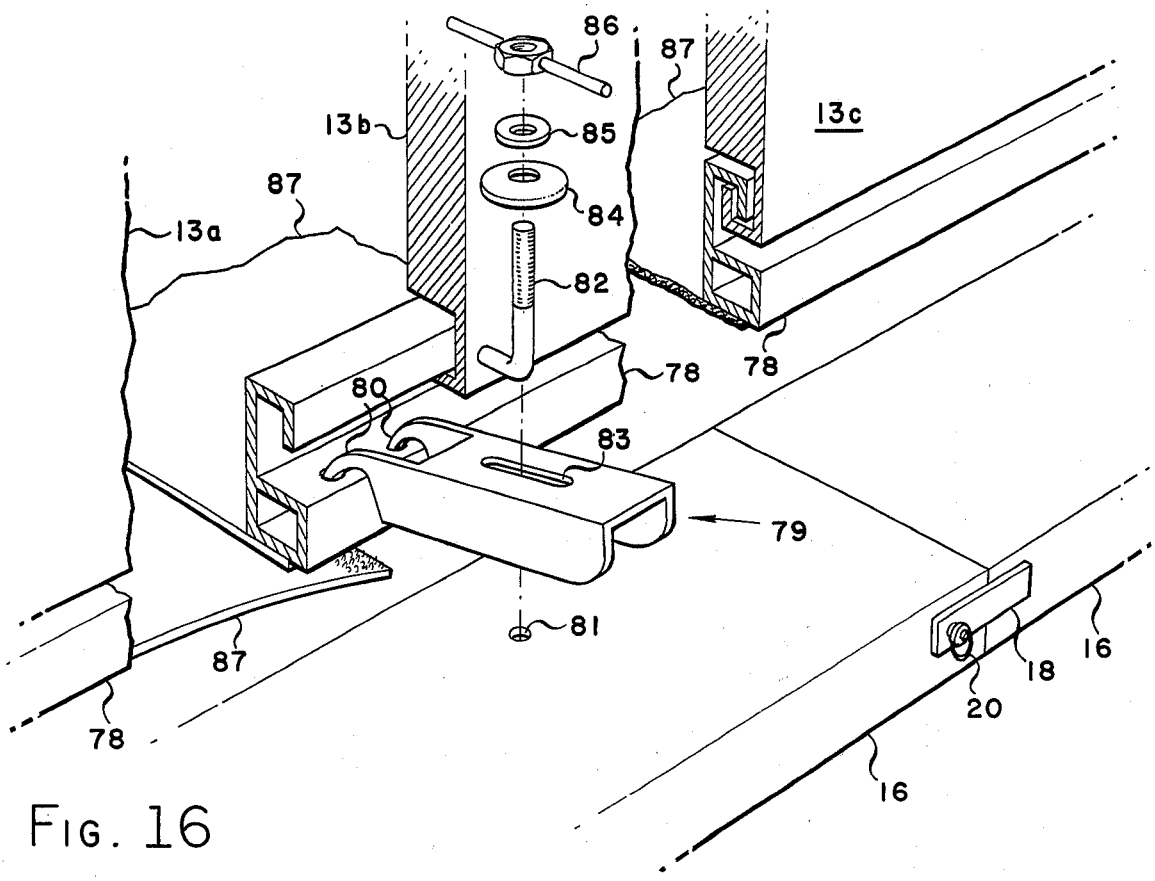
FIG. 16
FIG. 18
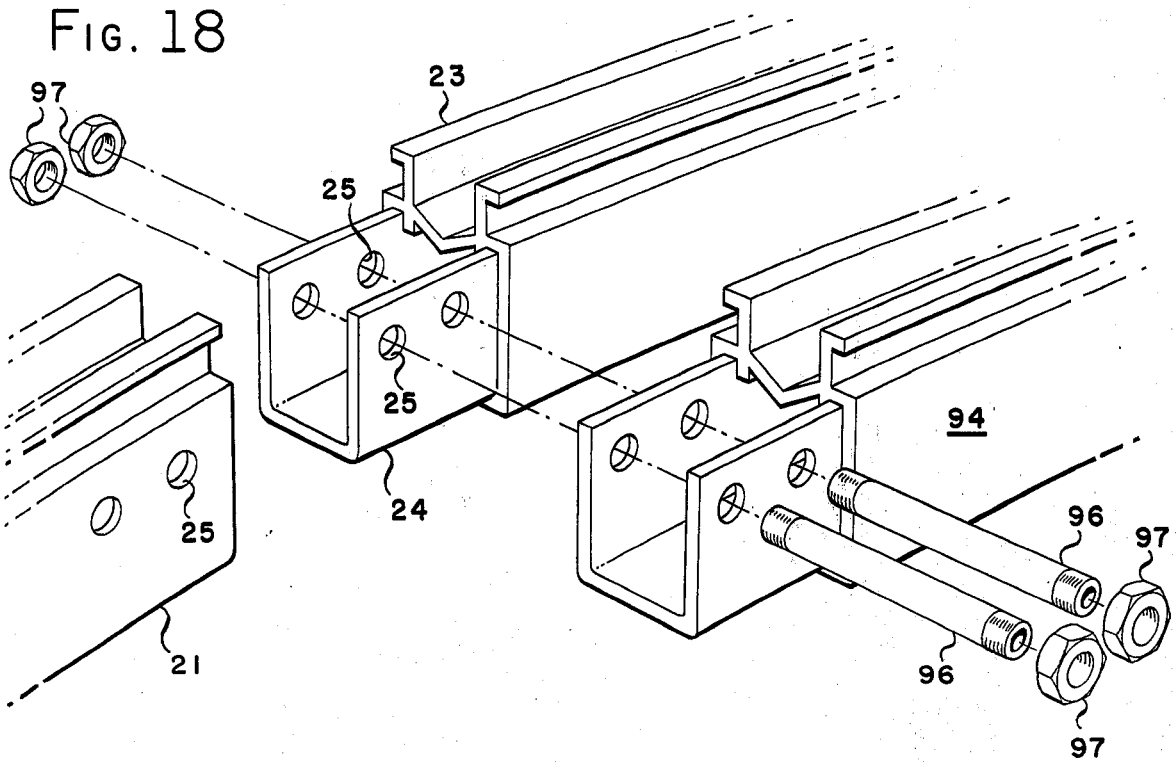

FIG. 23.
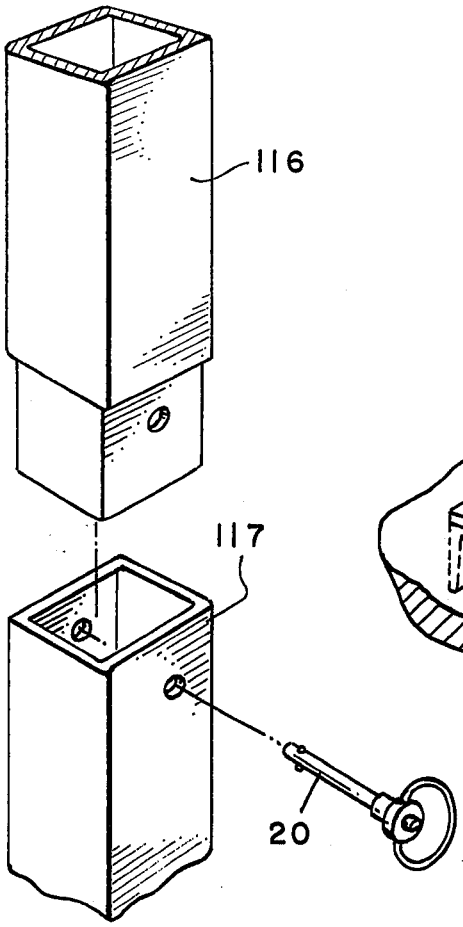
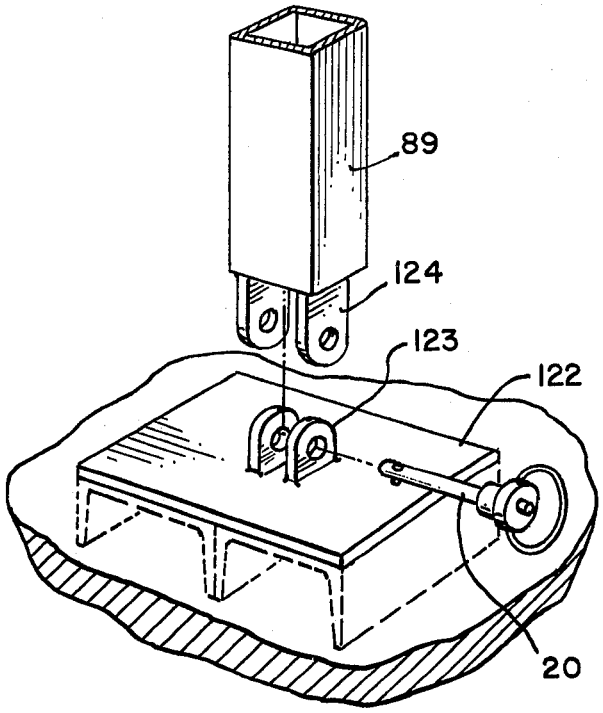
FIG. 25.
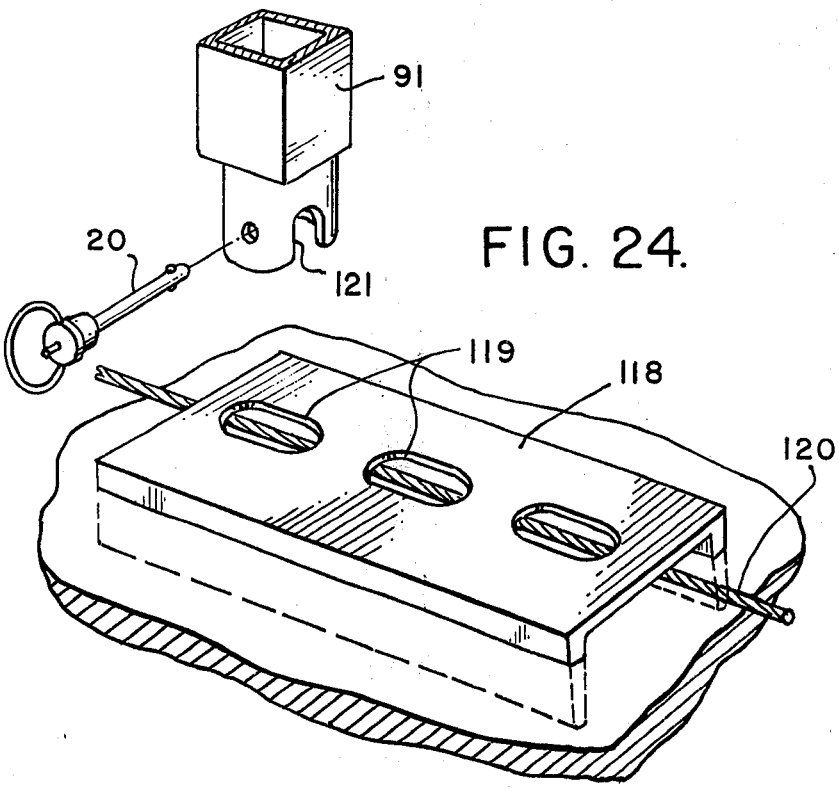
FIG. 24.

FIG. 26.
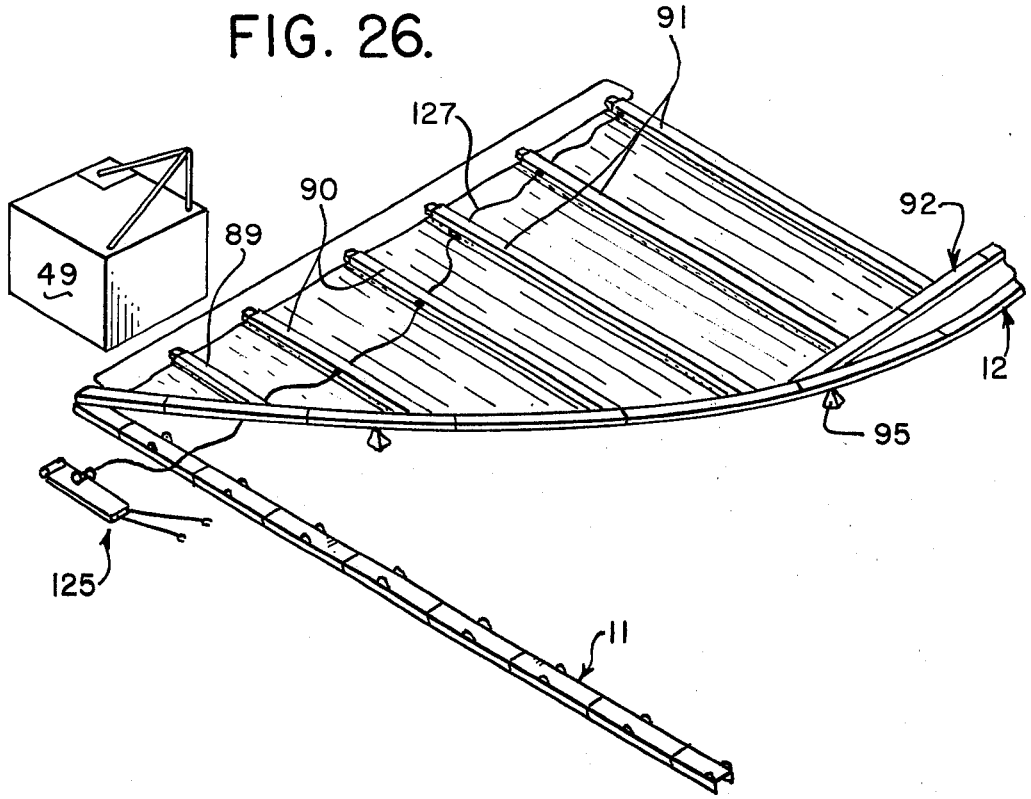
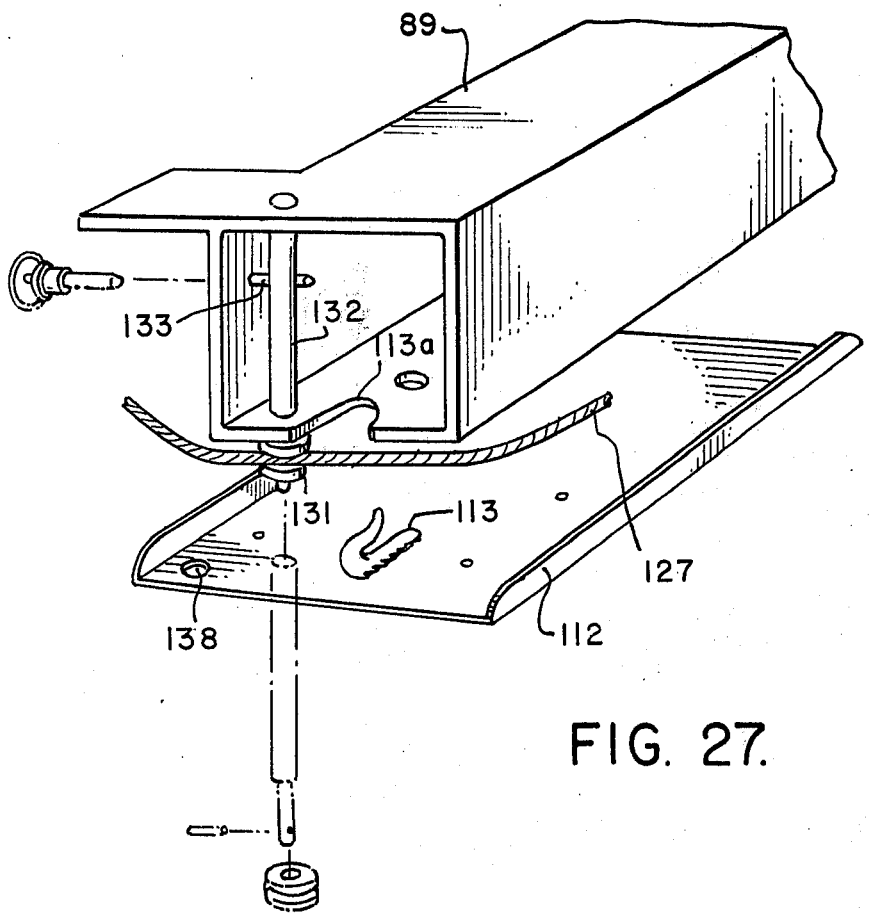
FIG. 27.

FIG. 28.
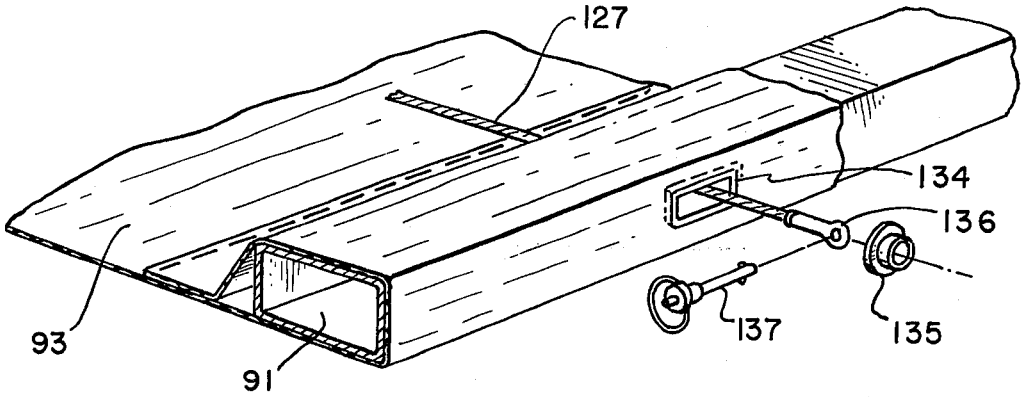
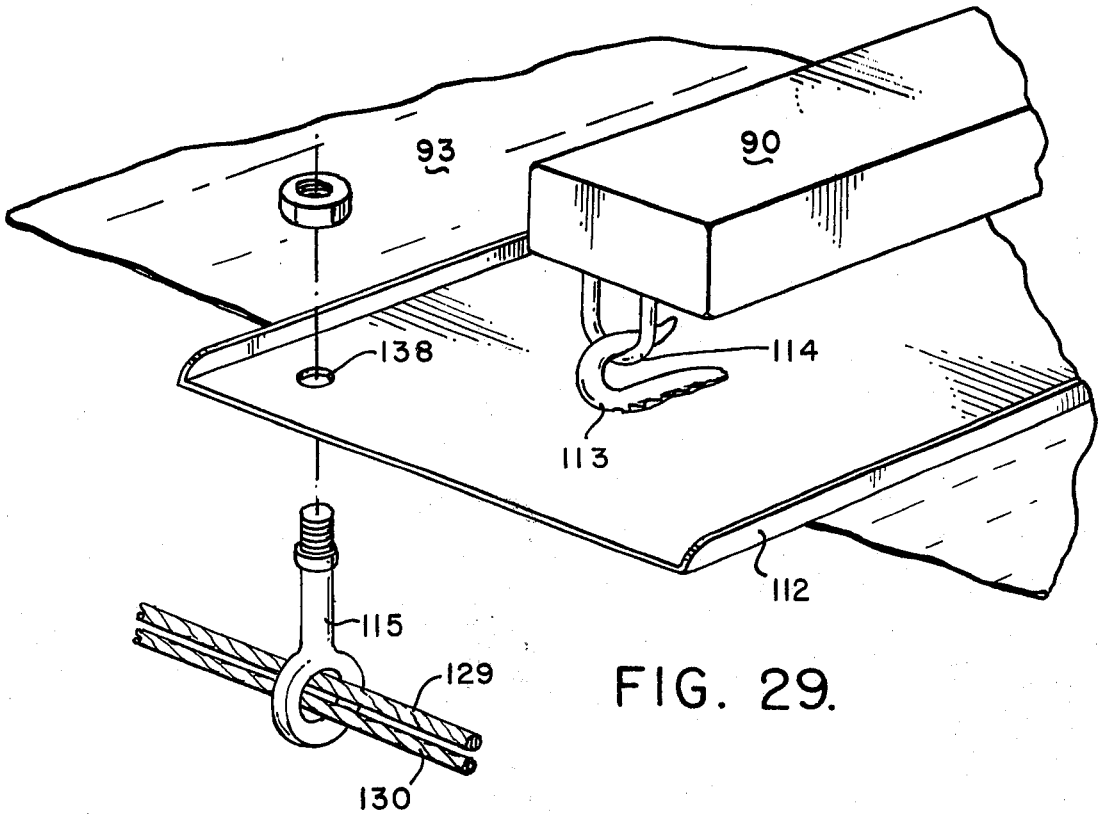
FIG. 29.

FIG. 36.
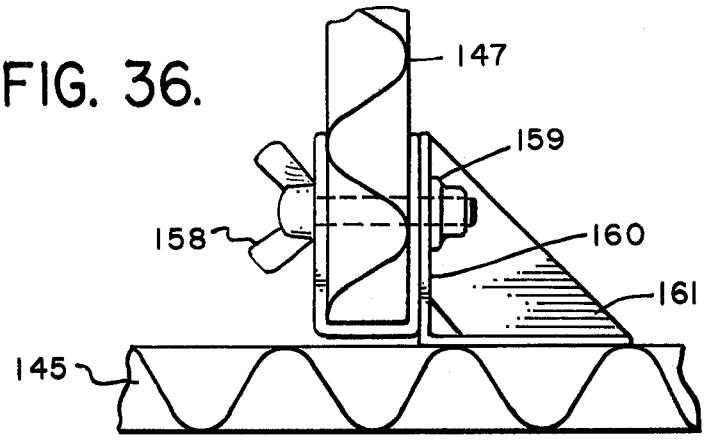
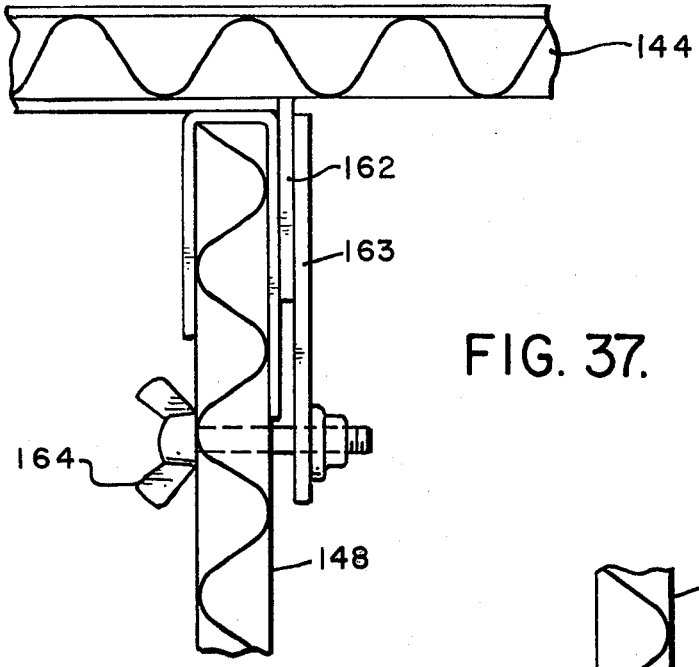
FIG. 37.
FIG. 38.
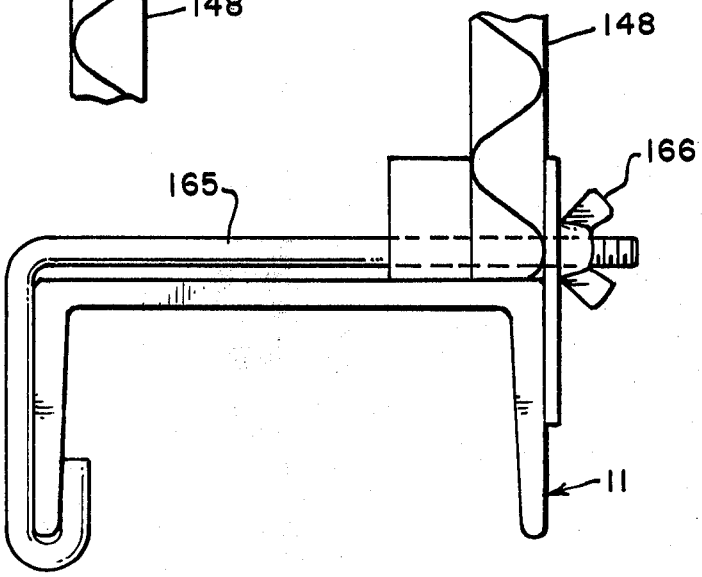

ERECTABLE SHELTER STRUCTURE AND METHOD OF ERECTION

This invention relates to a prefabricated erectable shelter arrangement and a method of erection, and more specifically, a prefabricated building structure that is formed by the assembly of preconfigured components which are easily handled and assembled at ground level by as few as two men and the method of assembly and erection permitting complete erection of the structure whereby the entire overhead structure is erected and sealed without requiring assembly and/or erection personnel to physically move themselves above ground level once erection has begun at a site with minimum site preparation that does not require absolute ground levelling.

While there are similar prior art approaches to a prefabricated portable, erectable building or shelter along the lines of this invention, as shown in U.S. Pat. Nos. 3,535,834 and 3,572,002, the unique and novel features of this invention pertain to the ability to permit assembly and erection from a pair of parallel, laterally spaced base rail assemblies wherein the longitudinal extension when located on the ground may vary in elevation either in an up or down direction as much as one inch per linear foot. Also, as compared to the prior art cited above, this invention contains the novel and unique features of a structural arrangement whereby when the erectable support members are located in their upright positions and the covering panels put in place there is accomplished an automatic water and weather-proofing seal over the entire covering or overhead shelter assembly, with both the overall erection and effective sealing benefits being obtained without any erection personnel having to remove themselves from ground level to go on or over the erectable structure.

Accordingly, it is an object of this invention to provide shelter structures erectable from prefabricated components at a site for which levelling of the ground portion the erected structure is in contact with is less critical then heretofore known or required.

Another object of this invention is to provide shelter structures erectable from prefabricated components at a site in which erection can be accomplished with no requirement for erection personnel to leave the ground or ground-contacting component levels to seal or assemble an erected structure.

A further object of this invention is to provide shelter structures erectable from prefabricated components at a site from a plurality of common prefabricated components which can constitute an overhead shelter or an enclosed shelter with end door closures which are substantially assembled and erected entirely at ground level.

Another object of this invention is to provide shelter structures erectable from prefabricated components at a site and which can be subsequently disassembled or dismantled and moved to another location for reassembly and re-erection with removal of all components from the original and re-usable at a subsequent site.

Still a further object of this invention is to provide shelter structures erectable from prefabricated components at a site in which the prefabricated components are small enough to be handled by one or two men and which can be assembled or erected from ground level without the necessity of cranes or other specialized erection vehicles on site.

Still another object of this invention is to provide shelter structures erectable from prefabfricated components in which all prefabricated components and equipment for site assembly and erection are of a size for easy and readily containerization for minimal effort in transporting to a site, or from site to site, by air, rail, ship, or common truck.

Another object of this invention is to provide shelter structures erectable from prefabricated components at a site in which the structures can readily and hastily assembled and erected on site with a minimum of personnel, site preparation, and not requiring any special assembly or erection equipment other than such that is containerized and readily transportable with the structure prefabricated components.

Yet a further object of this invention is to provide shelter structures erectable from prefabricated components at a site and which can be modified to include a side entry door by the substitution of a group of prefabricated members for some of the regular side panel members between any adjacent pair of upright arch assemblies receiving panels therebetween.

Further objects and advantages of this invention will become apparent from the following description taken in connection with the accompanying drawings in which:

FIG. 1 shows a perspective overall view of an erected structure of one embodiment of this invention;

FIG. 2 depicts the details of a base rail assembly utilized in this invention;

FIG. 3 shows the arrangement of the component assembled relationship of an upright arch member laid out and assembled on the ground and connected to the base rail assemblies prior to erection;

FIG. 3A is an exploded perspective view of the interconnection and assembly of two members of an upright arch structure;

FIG. 4 is an exploded perspective view showing the pivotal connection of the upright arch assemblies to the base rail assemblies and the water drainage details from the upright arch assemblies;

FIG. 5 is a perspective view of one of the side wall panels that fits between each pair of adjacent upright arch assemblies;

FIG. 6 is a view taken along line 6—6 of FIG. 5;

FIG. 7 is a view taken along line 7—7 of FIG. 5;

FIG. 8 is a view taken along line 8—8 of FIG. 5;

FIG. 9 is a partial cross-section schematic showing details of the upright arch assemblies and the interconnections of the adjacent panel members of each upright member in their installed position;

FIG. 10 is a partial cross-section showing the longitudinal interconnection between adjacent panel members when installed between each pair of adjacent upright arch assemblies;

FIG. 11 shows one embodiment of a typical type of A-frame assembly that can be utilized in the erection of a shelter of this invention;

Figure 12:
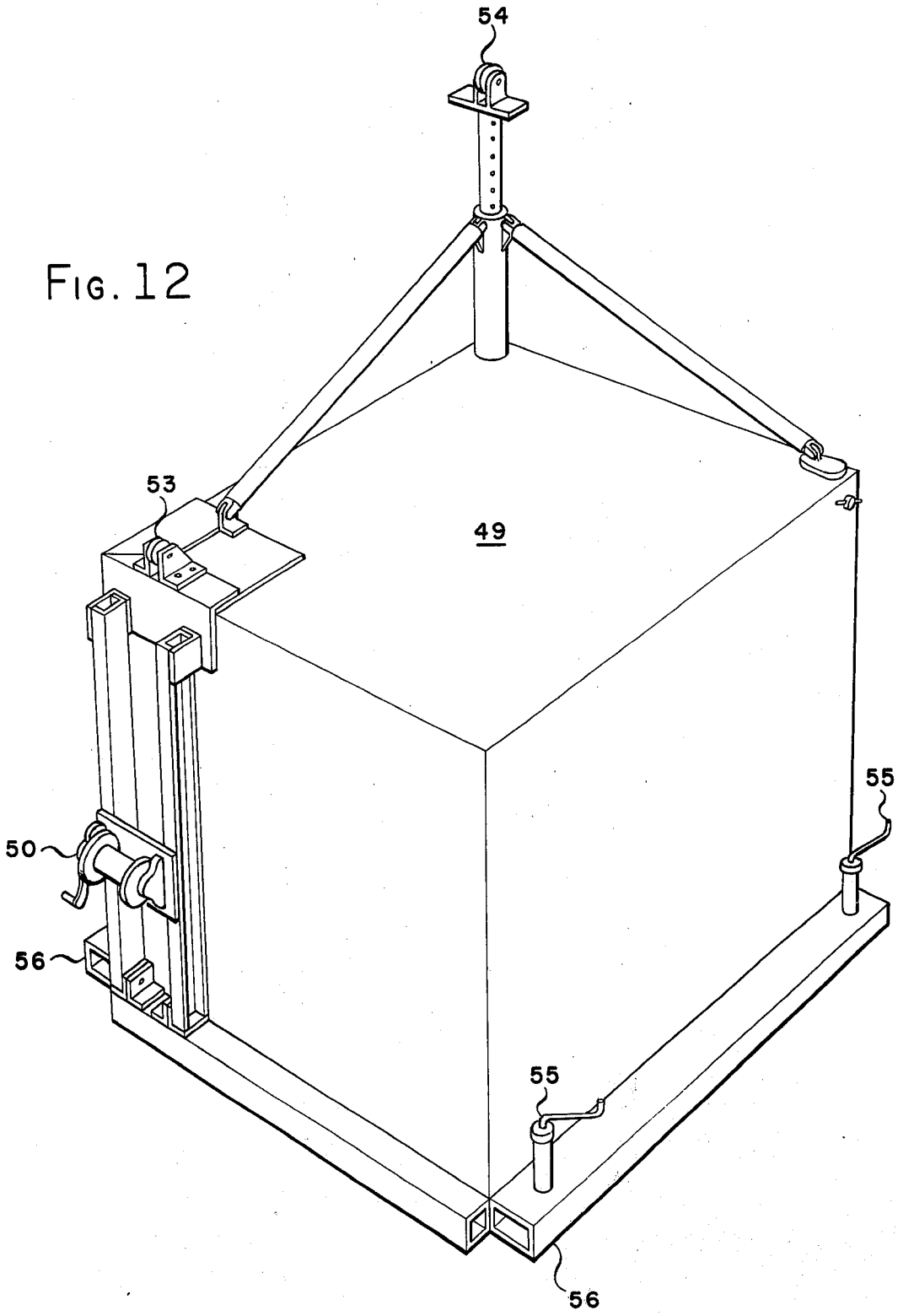
Figure 17:
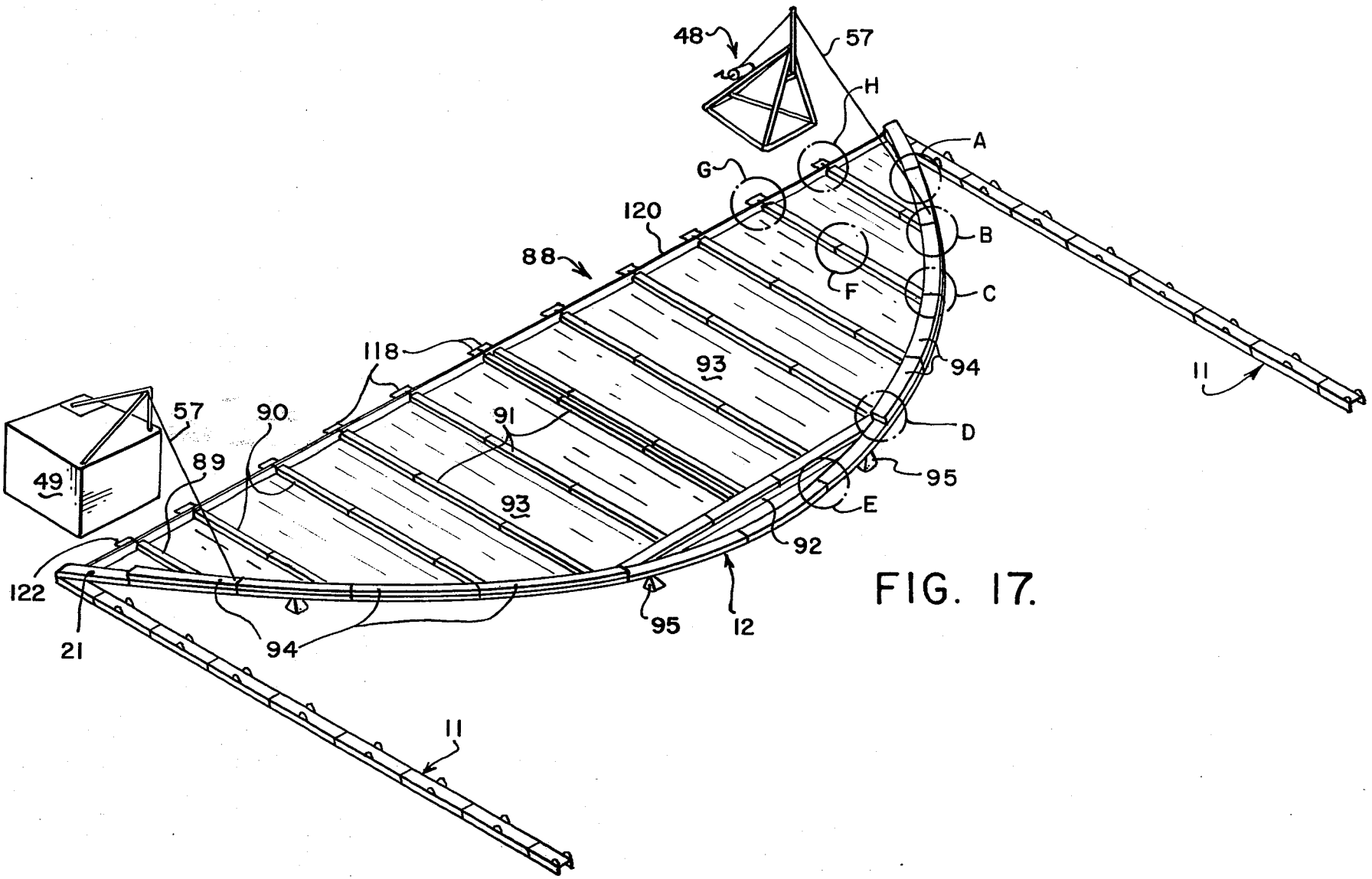
Figure 19:
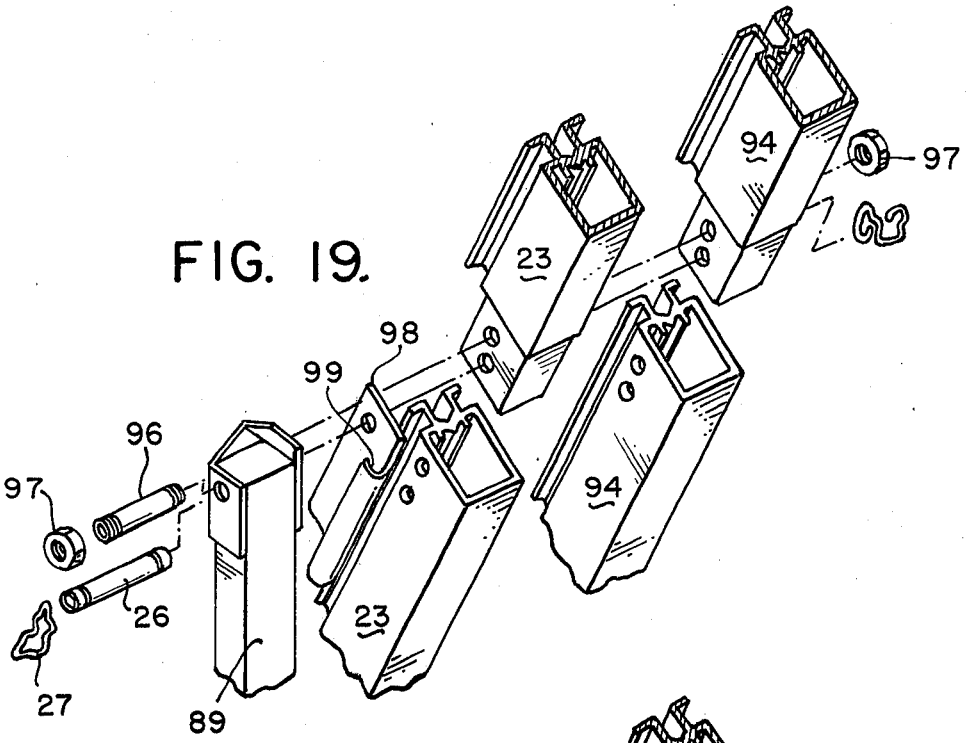
Figure 20:
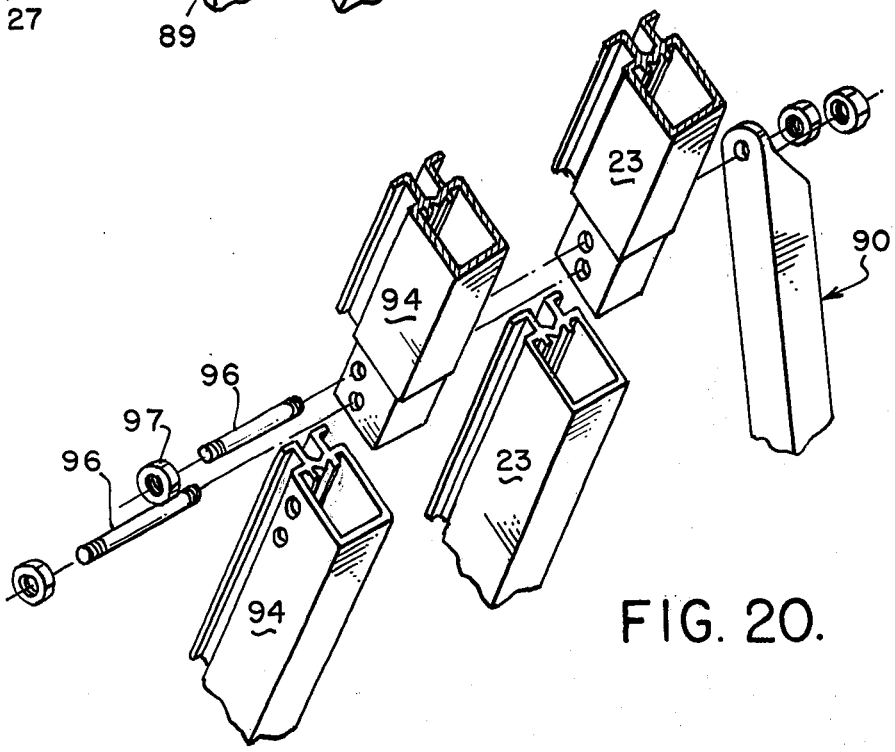
Figure 21:
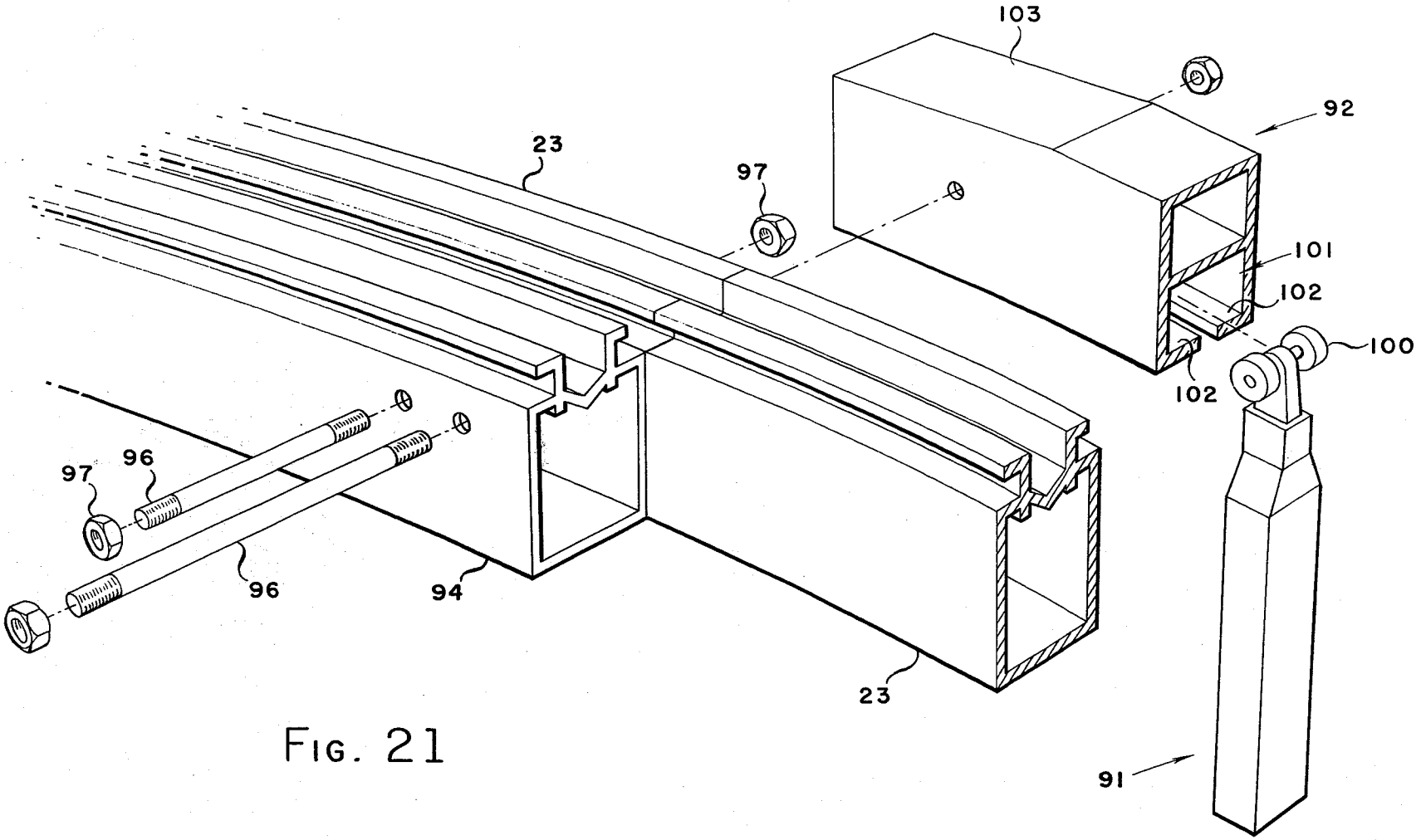
Figure 22:
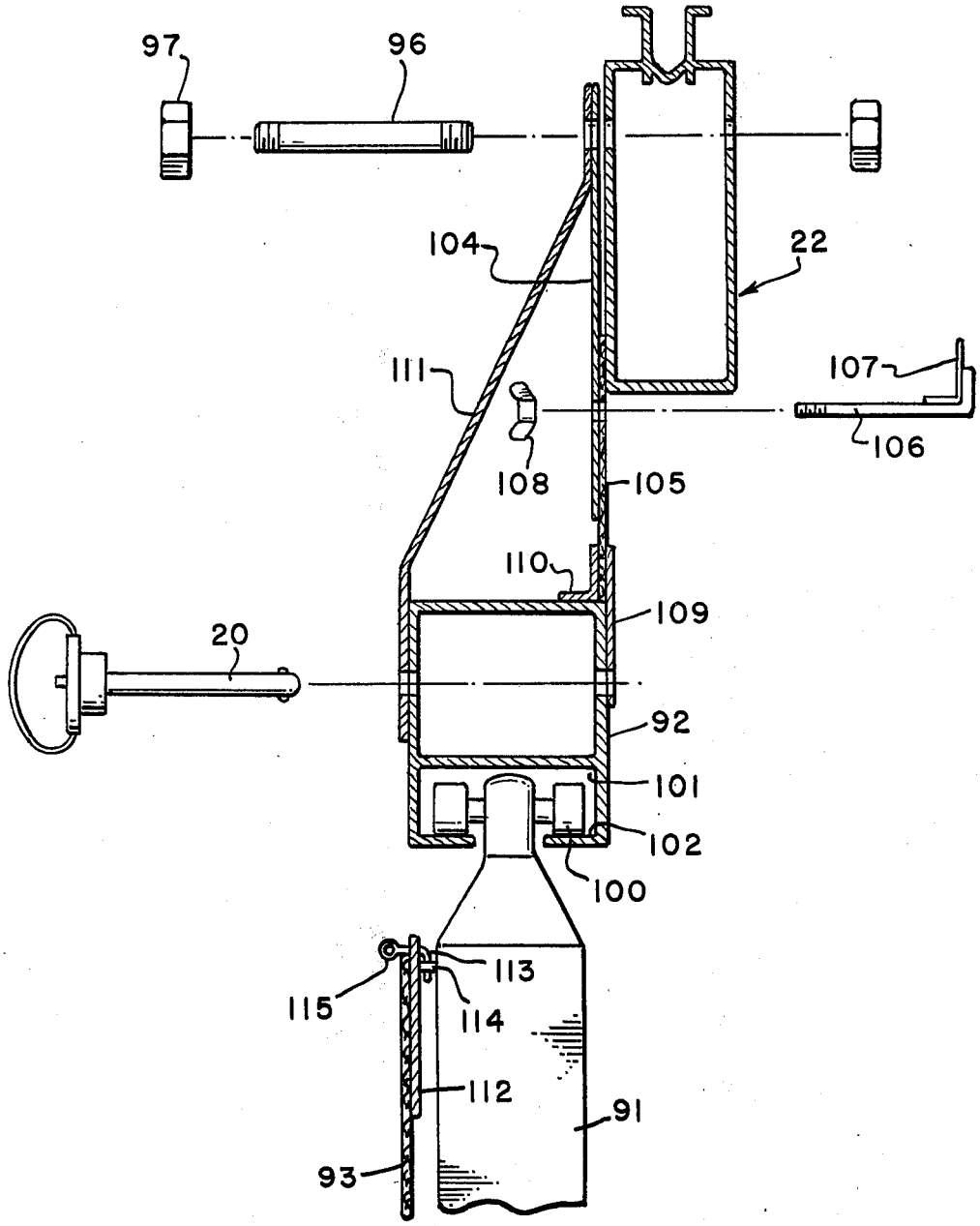
Figure 31:
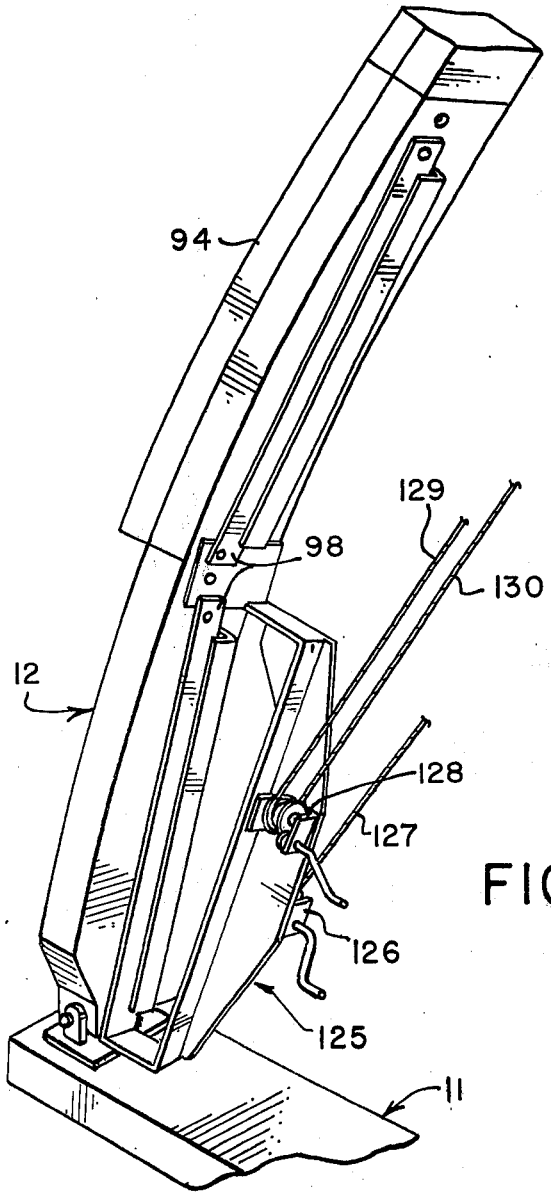
Figure 32:
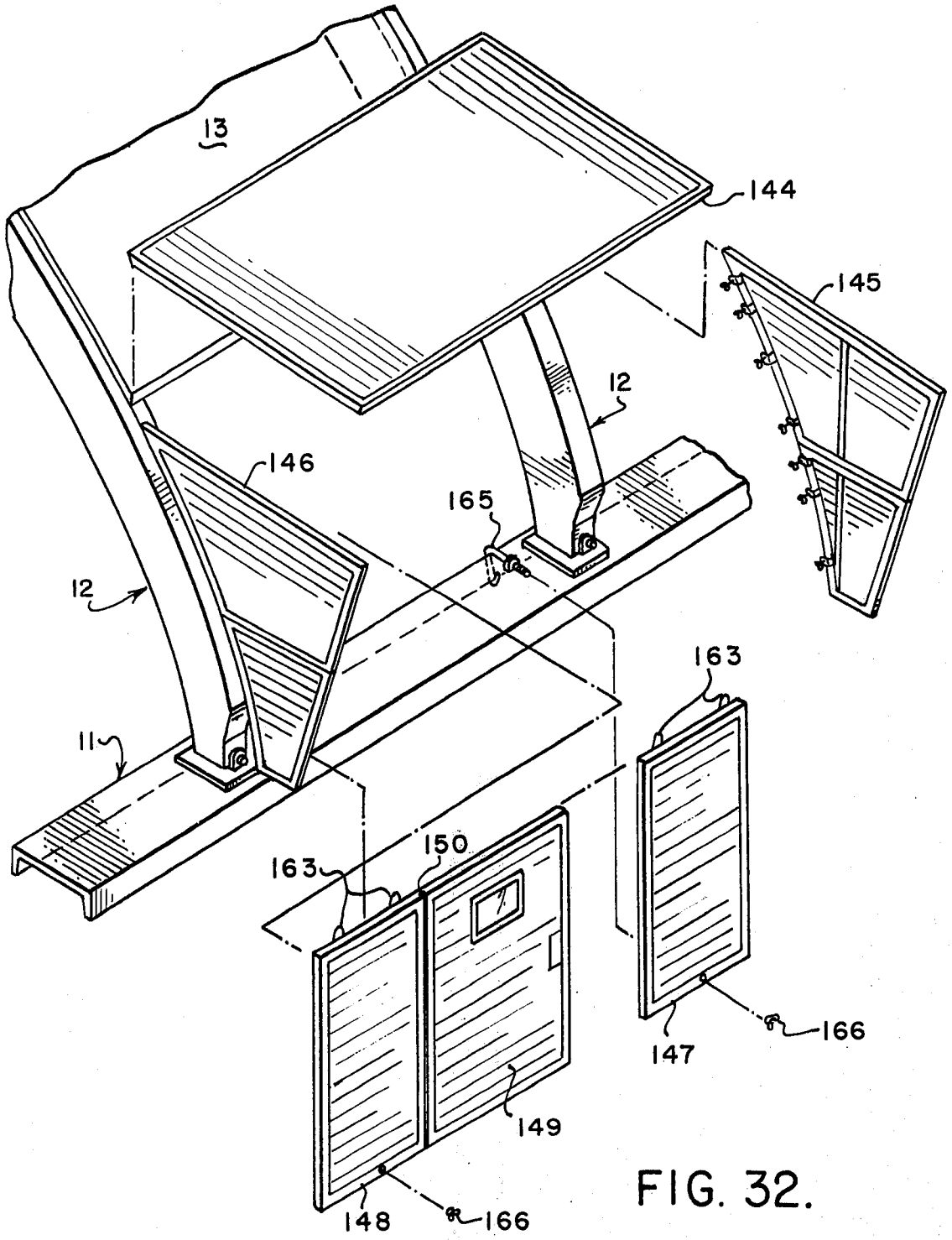

FIG. 12 shown an alternate type of erection device which is assembled on a shipping container utilized to transport various components of the structure of this invention;

FIG. 13A through 13H shown the sequential steps and details in lay-out, assembly, and erection of various components for the field or site erection of one embodiment of the structure of this invention;

FIG. 14 is a perspective view of an erection tool or aid used to properly space adjacent upright arch assemblies before the interlocking panel members are installed;

FIG. 15 shows an erection tool or aid for movement of the sidewall panels already installed between a pair of adjacent upright arch assemblies to enable all panel assemblies installed between each adjacent pair of upright arch assemblies from the ground level;

FIG. 16 depicts an apparatus and method for clamping a row of panels to the base rail assembly and attaching ground flashing to each lowermost panel;

FIG. 17 shows in perspective the relationship of a fabric door end closure assembly to the first upright arch assembly after assembly on the ground and before erection of the first upright structure;

FIG. 18 shows an exploded perspective view of an upright structure member having a fabric door of FIG. 17 connected thereto in circle A of FIG. 17;

FIG. 19 is an exploded perspective view showing details of mounting the fabric door to an upright structure at circle B of FIG. 17;

FIG. 20 is an exploded perspective view showing the details of assembly of the fabric door to the upright structure at circle C of FIG. 17;

FIG. 21 is an exploded perspective view showing the details of assembly of the fabric door to the upright structure at circle D of FIG. 17;

FIG. 22 is an exploded perspective view showing the details of assembly of the fabric door to the upright structure at circle E of FIG. 17;

FIG. 23 is an exploded perspective view of one embodiment of a door column joint at circle F of FIG. 17;

FIGS. 24 and 25 are exploded perspective views showing details of connection of door columns to ground engaging base plates at circles G and H respectively of FIG. 17;

FIG. 26 shows some schematic details of the fabric end closure door rigging assembly for opening and closure of the door when the vertical beam structure is upright;

FIGS. 27 through 30 show cable rigging details of the fabric door end closure assembly for opening and closing said door assembly;

FIG. 31 shows one arrangement of mounting the door opening and closure winch assemblies to the end upright structural assembly the door is mounted on;

FIG. 32 is an exploded perspective view of members comprising a side entry door assembly for attachment to the erected structure between two of the upright beam assemblies;

FIGS. 33 through 38 show connection details of various members of the side entry door embodiment of FIG. 32.

Referring more particularly to the drawings, there is shown in FIG. 1 an overall view of a shelter 10 constructed in accordance with this invention, but without any end door or end closures or side door entries (all of which will be discussed hereinafter). The basic components of shelter 10 comprises a pair of base rail assemblies 11, a plurality of arch assemblies 12, and a plurality of panel members 13 interconnected to and extending between each adjacent pair of arch assemblies 12; the specific details of base rail assemblies 11, arch assemblies 12 and panel members 13 being explained in more detail below.

Referring now to FIG. 2, the base rail assemblies 11 consists of end base rail members 14 and 15 with any number of standard or intermediate base rail members 16 located between members 14 and 15; the quantity of standard or intermediate members 16 being dependent upon the length of the shelter to be constructed. Members 14, 15, and 16 are all of an elongated or inverted U-shaped channel cross-section configuration, and have a clevis or yoke member 17 mounted on the upper surface thereof. The interconnection between adjacent members of the base rail assembly 11 consists of one member having a pair of straps 18 extending longitudinally from the side webs of the U channel, which in turn will extend over the outer surfaces of the end of the adjacent base rail member having a hole 19. Upon alignment of a corresponding hole in strap 18 with the hole 19 of the adjacent base rail member, the members are secured together by insertion of ball lock pins 20, or any other appropriate locking means, through the aligned holes in strap 18 and hole 19 of adjacent base rail members.

The location of clevis or yoke 17 on the standard or intermediate base rail members 16 is substantially in the longitudinal center thereof with the longitudinal lengths of members 16 configured to locate the longitudinal placements of clevises 17 at the appropriate distance for pivotal connections of adjacent arch assemblies 12 at an appropriate spacing to enable connection of panel members 13 between each adjacent pair of arch assemblies 12 as will be explained in further detail hereinafter. Likewise the placement of clevis members 17 on end base rail members 14 and 15 from the ends connectable to members 16 is substantially one-half the distance of the spacing between adjacent arch assemblies 12 when installed and erected.

Referring now to FIG. 3, there is shown a schematic of arch assembly 12 when laid out and assembled on the ground and connected to the clevis 17 on base rail assemblies 11 prior to erection of arch assembly 12. Arch assembly 12 comprises a ground beam member 21 at each end thereof, a center beam member 22 and a plurality of standard or intermediate beam members 23 located between the center beam member 22 and ground beam members 21. The quantity and radius of the individual beam members will be dependent upon the desired configuration and size of span and height of arch assembly 12 in accordance with known and accepted geometric principles.

The interconnection of various beam members is shown in FIG. 3A in which the right-hand beam member 23 has an end projection portion 24 that will slide into the interior of the left-hand beam member 23 whereby a telescopic connection between the beam members 23 is established. The end projection portion 24 of beam 23 contains holes 25 which are in turn aligned with corresponding holes 25 of the beam member 23 receiving the projection 24 and upon the insertion of hollow assembly pin 26 through the holes 25, the two beam members 23 become connected. The pins 26 are hollow for purposes of weight reduction as well as passages for erection cables and other purposes to be described in more detail hereinafter, and are retained in their positions through holes 25 by retention clips 27 springingly-located in grooves 28 in the pins 26. It is also to be recognized that any appropriate retention means for retaining pins 26 in holes 25 may be used other than that shown such as a threaded engagement by threading the ends of pins 26 and mounting threaded nuts thereon.

It is also to be understood that the connection of adjoining beam members shown in FIG. 3A is typical throughout the arch so that a ground beam member 21 would have its end configured the same as shown for the left-hand beam 23, while the center beam member 22 would have both of its ends configured the same as that shown for the right-hand beam 23.

Referring specifically to FIGS. 3A and 9, the configuration of beam members 23 is such that there is a hollow interior 29 extending completely through the arcuate longitudinal extension thereof with a pair of inverted L-shaped flanges 30 extending upwardly from the upper surface whose webs are laterally spaced to provide a channel 31 having a V-bottom 32. Throughout the longitudinal length of the V-bottom 32 are spaced holes 33 which serve to permit gravity flow of any water from rain, snow, or other weather conditions that enter into the volume of channel 31 between panel members 13 as explained in more detail hereinafter to pass to the bottom 32 of beams 23 and subsequently into the beam interior 29. The interior 29 of beam member 23 as shown in FIG. 9 extends also through the center beam 22 and the ground beam members 21 to a ground beam end portion 34 as seen in FIG. 4. The end 34 of ground beam 21 contains a hole 35 extended throughout which when placed into the clevis or yoke member 17 of the base rail assembly 11 will permit that end of arch assembly 12 to be connected with the base rail assembly 11 by pin 26; the pin 26 being retained by retention clips 27 located or locked in grooves 28 on pin 26. The ends 34 of ground beam members 21 are provided with a spout or drainage device 36 to which an appropriate hose device 37 is mounted by a clamp 38 whereby water may drain from the interior 29 of the overall arch assembly 12 to the exterior of the overall structure of shelter 10. The length of hose 37 can be whatever distance any water drainage may be desired to be released away from the overall shelter.

At the end of each ground beam member 21 there is a cut-out 39 of the upper surface of the L-shaped flanges 30 for an arcuate distance that is at least the width of a panel member 13 which permits the mounting of panel members 13 to each pair of adjacent arch assemblies 12 as will be discussed in more detail hereinafter.

As shown in FIGS. 5, 6, 7, and 8 the panel members 13 are of a substantially flat rectangular construction, the length of which (or biggest dimension as shown in FIG. 5) is such as to span the distance between the confronting flange members 30 of each adjacent pair of arch assemblies 12. Across each end of panel member 13 is a channel arrangement 40 configured so as to permit passage of the L-shaped flanges 30 on arch assemblies 12 to pass therethrough so as to permit the sliding or movement of a panel member 30 arcuately over the tracks formed by the flanges 30. In each corner of the bottom side 13*a* of each panel 13 there is a lug projection 41 extending into channel 40 so as to reduce the outermost width of channel 40; that is the distance between the confronting surfaces of lug 41 and the opposite sidewall 42 of channel 40 as seen in FIG. 6 being less than the distance between surfaces 42 and 43 in FIG. 7. The bottom of channel 40 located beneath lug 41 and extending outwardly to the ends 40A of channel 40 is formed of an arcuate of curved surface 44 which can ride on the upper surfaces of flanges 30 of the beam members forming arch assemblies 12. By virtue of the cut-outs 39 in flanges 30 on the ground beam members 21 as shown in FIG. 4, a panel 13 may be set on a pair of adjacent beam members 21 of adjacent arch assemblies and when moved upwardly in a sliding motion the lugs 41 will pass underneath the upper lip of flanges 30 so as to secure the panel between the pair of adjacent arch assemblies 12 in a manner best seen in FIG. 9.

The portion of channel 40 extending between lugs 41 is sized to eliminate any contact between channel 40 and flanges 30 thereby minimizing any frictional interference by the sliding of the panels 13 over the pair of adjacent arch assemblies 12.

Referring to FIGS. 5, 8, and 13, the longitudinal edges of panels 13 provide interlocking structures for assembly or interconnection between adjacent panels 13 of a complementary double tongue and groove connection. One edge of the panel members 13 is configured with a J-shaped cross-section 45 that projects substantially laterally fron the plan of an outer surface of panel 13 and forming a channel 45*a* in which is located an appropriate sealing device 46 which can be a rubber or elastomeric hose or tube which is deformable. Along the opposite side edge of the panel is another extension 47 of a J-shaped cross-sectional shape projecting in a plane below the outer surface of panel 13 to form a channel 47*a* having another similar appropriate sealing device or member 46 located along the bottom thereof. As seen in FIG. 13, this permits a sliding type hooking engagement between each pair of adjacent panels 13 with the connection between panels 13 effectively sealed through the deformation of the sealing devices 46 by the engagement of the lip of the other panel.

In order to accomplish the raising of the arch beam assemblies 12 into a vertical position once they are assembled on the ground and pivotally connected to the base rail assemblies 11 as explained hereinbefore, one method has been found of ready ease through the use of a pair of cable and winch arrangements. For example, in FIG. 11 is shown an A-frame structure 48 that is assembled from appropriate components that can be packed in a shipping container 49 of FIG. 11 along with various other components of the structure 10. The A-frame 48 includes a winch device 50 and a pulley 51 mounted at the top of a most over which the cable from the drum of winch 50 may run to the arch assembly 12 to be erected to its vertical position. This arrangement can operate as well to lower the arch assembly 12 upon disassembly of structure 10. Appropriate levelling devices 52 may be incorporated in the A-frame 48 to fix a desired attitude of A-frame 58 so that the site or location for the A-frame 48 does not have to be absolutely level or require extensive side preparation.

In FIG. 12 there is another arrangement that can be used in lieu of, or in conjunction with, the A-frame structure 48 shown in FIG. 11, this arrangement constituting components that are assembled and mounted on a shipping container 49 utilized to transport components of the base rail assemblies 11, the arch assemblies 12 and panels 13. In this arrangement the winch assembly 50 is mounted on the side of a container 49 with pulleys 53 and 54 mounted thereto for passage to the arch beam assemblies 12 being raised or lowered in the same manner as discussed with the A-frame 48 of FIG. 11. Because of the lack of a straight line between winch 50 and pulley 54, pulley 53 is included. Also, appropriate levelling devices 55 are included by connection to a pair of side rail members 56 mounted to the container 49 on opposite sides thereof; the function of levelling devices 51 operating in the same manner attributed to the levelling devices 52 with A-frame 48 discussed above.

In explaining the preferred method of erection of shelter 10, reference is now made to FIGS. 13*a* through 13*h*. The base rail assemblies 11 are laid out longitudinally and spaced equidistant laterally for the span of arch assemblies 12. A base rail assembly 11 need not be on ground or site of the same level relative to the other base rail assembly 11, as well as the longitudinal extension of each base rail assembly 11, need not be level. It has been found that as much as one inch difference in elevation per linear foot of longitudinal extension of the individual rail members 14, 15, and 16 form base rail assemblies 11 can exist or be tolerated while still accomplishing erection of a structure 10 as set forth herein. For example, in a situation where the longitudinal length of the standard or intermediate base rail members 16 is approximately 8 feet to accommodate panels 13 of approximately 8 feet length bridging adjacent arch rail assemblies 12, one end of rail member 16 may be up to 8 inches above or below the elevation of the opposite end and erection of the arch rail assemblies 12 and insertion of panels 13 can still be accomplished for erection from ground level. Also, the longitudinal elevation and variation for the individual members of base rail assemblies 11 need not be all in the same direction in that moving longitudinally along the overall length of three base rail members 16 of 8 foot length each, and starting from a zero point in length, the end of the first rail member 16 may be up to 8 inches above or below its other end at the zero point, while the end of the second rail member 16 remote from the first rail member 16 may be as much as 8 inches above or below its end connected to the first rail member 16. Thusly, the ground site each base rail assembly 11 may traverse may be of a combined rising and falling in a wave-like nature. Accordingly, a shelter 10 of this invention can be erected at a site location that need not be absolutely levelled and if site preparation is necessary, it can be minimized.

After the lay-out of base rail assemblies 11 as shown in FIG. 13*a*, A-frame assemblies 48 and/or shipping containers 49 containing winches 50 are located respectively at one end of each of the base rail assemblies 11; it being noted that a pair of shipping containers 49 may be adapted to incorporate winches 50 as shown in 13*b*, or a pair of A-frame assemblies 48 may be utilized.

As shown in FIG. 13*b*, the appropriate beam members 21, 22, and 23 forming arch assembly 12 can be laid-out and assembled on the ground with the ground beam members 21 pivotally connected to the appropriate clevises 17 on the base rail assemblies 11. After such connection of the arch assembly 12 to base rail assemblies 11, cables are run from winches 50 to an appropriate hole or retaining device on arch assemblies 12 and by winding the cables on both winches 50, the arch assembly 12 is drawn into a vertical position as shown in FIG. 13*c*; the preferred arrangement being that cables from winches 50 are connected to the hollow pins 26 used to assemble or connect the individual beam members comprising an arch assembly 12.

It is to be here noted that in FIGS. 13*b*, 13*c*, and 13*d* an end closure or door assembly for the first arch is shown, the details of which will be discussed below. Passing to FIGS. 13*g* and 13*h*, the erection of the first arch assembly 12 is accomplished by passing a cable 57 from winch 50 through one of the hollow pins 26 used to join two adjacent beam members 23 as shown in the exploded perspective view of FIG. 13*g*. The cable 57 has a tag line or handling rope 58 connected thereto by a splice mechanism 59 which is small enough to pass through the hollow interior of pin 26. Once splice mechanism 59 is passed through pin 26, an appropriate cable clamp member 60 is mounted on cable 57 adjacent the splice 59 so that as cable 57 is drawn back onto the drum of winch 50, clamp 60 will contact the end of pin 26 and lift arch assembly 12 into an upright position. An appropriate-sized spacer device 61 is placed around or near cable 57 and between the pulley 54 of the erecting A-frame device and the arch beam assembly 12 so as to prevent travel of arch assembly 12 beyond its substantially vertical position, and once the first arch assembly 12 is in its substantially vertical position, an appropriate strapping, locking or retaining means 62 can be utilized by passing an appropriate retention pin through the interior of the other hollow pin 26 for the joint, followed by strapping or trying it to a readily accessible portion or member of the A-frame erecting mechanism. It is to be noted that this retention of an arch assembly 12 to the A-frame erecting devices is necessary only for the first arch assembly 12 as once the second or next adjacent arch assembly 12 is erected and the panels 13 are mounted on the rails 30, the interconnections are such that there is no need for any vertical retention of any arch assembly 12.

Referring back to FIG. 13*d*, once the first arch assembly 12 is erected and appropriately connected for vertical support as shown in FIG. 13*h*, the second or next arch assembly 12 is assembled on the ground and pivotally connected to the base rail assemblies 11 with cable 57 drawn through the hollow pins 26 in the first arch assembly 12 and connected to the second arch assembly 12 as shown in FIG. 13*g* for the erection thereof to a position as shown in FIG. 13*e*. To properly space the second arch assembly 12 from the first one, a spacing bar tool 63 having a slot 64 for placing over cable 57 is so placed on each cable 57 intermediate the arch assemblies 12 personnel at ground level. Thusly, with the tension retained on cables 57 the two arch assemblies 12 are now erected in a substantially vertical position, are properly spaced to permit panels 13 to be placed on the flanges 30 of the arch assemblies 12 whereby the lugs 40 of panels 13 pass through the cutouts 39 and move upwardly in the direction of arrow 65 of FIG. 13*e*. As each subsequent panel 13 is placed to bridge the distance between the adjacent arch assemblies 12, the panel 13 being added is appropriately maneuvered to engage the sealing interconnection between the adjacent panels as shown in FIG. 10.

The sequence of erection of arch assembly 12 through reaction of cables 57 and insertion of panels 13 throughout the entire arch length is continued on an arch-by-arch basis until the final arch for the building of the length desired is assembled on the ground as shown in FIG. 13*f* which too is shown with an end closure member assembled on the ground and attached to the last arch assembly 12 if such end closure is desired.

FIG. 15 shows a panel winch assembly installed between a pair of adjacent ground beam arch members 21 for use in installing and/or removing a row of panels 13. Panel winch 66 comprises an upper pulley section 67 and a lower pulley section 68 which are held in an operative position by a box or coupling device 69 that is securely fastened to one of the pulley sections 67 or 68 with the other pulley section telescoped therein. The lower pulley section 68 is pivotally connected to a winch pad 70 which in turn is mounted through an appropriate nut and bolt or pin arrangement extending through appropriate holes in the base rail section 16. The upper pulley section 67 is pivotally connected to a winch support bar 71, which in turn is connected to each of an adjacent pair of ground beam arch members 21 by rods extending through the hollow assembly pins 26 that connect the ground beam arch means 21 with the arch beams 23. A winch 72 is mounted on upper pulley section 67 with a cable 73 extending from winch 72 up and over a pulley mounted on pulley axle 74 to a panel engagement bar 75. Thusly, as the number of the panels in the arch become sufficient that they cannot be physically pushed up and over the arch by manpower, the placement of panel 13 onto the rail members 30 to a position proximate that shown in FIG. 15, and the extension of cable 73 from winch 72 sufficient to place panel bar 75 in contact or connection with the bottom edge of the panel 13, followed by retraction of the cable 73 onto winch 72 will move panel 13 and all the previously installed panels in that arch upwardly and over the arch section. As the lowermost panel 13 reaches the upward extent of movement posssible by operation of panel winch 66, the installed panels 13 may be locked by a panel lock 76 on each side of ground arch 21 by a shaft extending into the interior of the other hollow assembly pin 26; the panel lock 76 consisting of a cammed surface which when rotated on the shaft extending into the hollow assembly pin 26 will place the camming surface into frictional engagement with the adjacent surfaces of the uppermost panel 13.

For disassembly of the structure by the removal of panels 13, the panel winch assembly 66 is also utilized for pulling the lowermost panel 13 and thus the subsequent panels 13 above it in a downward direction by the inclusion of an additional pulley mounted on an axle placed through holes 77 in the lower pulley section 68 so that cable 73 after passage over the pulley mounted on axle 74 passes down and around and under the pulley mounted in holes 77 so that retraction of cable 73 by winch 72 causes a downward motion on panel bar 75 and the installed panels 13 when bar 75 is connected to the lowermost panel 13.

Once all of the panels 13 are installed to constitute the entire or complete arch, the endmost panel 13 on each side of the arch is connected to the base rail members 16 by a tensioning device shown in FIG. 16 whereby the entire row of panels 13 are placed in tension and the seals between adjacent panels as shown in FIG. 10 become positively activated or engaged. In FIG. 16, for clarity purposes the lowermost panel 13 depicted is shown broken or segmented into panel sections 13*a*, 13*b*, and 13*c*. A ground flashing and tensioning bar 78 is connectively engaged along the lowermost end flange of panel 13 in the same manner as adjacent panels 13 are connected and engaged to each other (the sealing devices 46 as shown in FIG. 10 being omitted here for clarity). A tensioner or clamp 79 having a pair of cantilevered fingers or members 80 engaging appropriately placed holes in the bar 78 is placed in engagement with bar 78 and positioned over an appropriately located hole 81 in base rail member 16. The tensioning or clamping member 79 is secured to the base rail member 16 by a J-bolt 82 passing through slot 83 of clamp 79 into hole 81 whereupon the clamping and tensioning action of clamp 79 is established by the placement of a washer 84 having a convex upper surface and a washer 85 having a concave lower surface over the threaded extension of bolt 82 followed by the threaded engagement of a T-handled nut 86 threadedly engaged with bolt 82. An appropriate ground flashing or skirt material of a pliable weather-proof nature 87 is appropriately connected to bar 78 to extend down to and outwardly over the ground for any distance desired. Likewise, the flashing material 87 may have on its side edges an appropriate connecting means or devices for fastening, connecting, or assembling to the flashing 87 of adjacent pieces of flashing 87.

As indicated above should an end closure or door member for the structure 10 be desired, there shown in FIG. 17 a fabric door assembly 88 which has been assembled and connected to arch assembly 12 at the ground level prior to erection of arch assembly 12. Each half of door assembly 88 comprises a support column 89, a pair of pivot door columns 90, and three roller door columns 91. The support columns 89 are securely connected to arch assembly 12 while the pivot door columns 90 are pivotally connected to arch assembly 12, and the roller door columns 91 are slidably connected to a trolley beam 92 which in turn is connected at both ends in a secure manner to arch assembly 12. An appropriate weather impervious canvas or fabric door material 93 is connected to the various columns 89, 90, and 91 and arch assembly 12 on each half or side thereof so as to completely span or cover an entire one-half of the arch area when the doors are closed as shown in FIG. 17; each door half being rigged with cables in a manner the details of which will be discussed hereinafter so as to permit during opening operation, roller door column 91 in the center of the doorway moving toward the middle roller door column 91 of each side or half after which the two roller door columns 91 will move toward the outermost roller door column 91. Continuation of the opening of door 88 results in all of the pivot and roller door columns 90 and 91 to pivot respectively about their pivotal connections to arch assembly 12 and trolley beam 92 while the bases of columns 90 and 91 swing toward the stationary support column 89. It is also to be recognized that where the size or span of door 88 is small enough, the trolley beam 92 and roller door columns 91 may be omitted.

Any additional support or structure for arch assembly 12 which may be desired or necessary is accomplished by the addition of arch beam members 94 being assembled alongside the intermediate arch members 23 between the point of connection of the trolley beam 92 to beam assembly 12 and the ground beam member 21 of beam assembly 12. Details of various features of door assembly 88 and the connection thereof to beam assembly 12 identified by various circle portions A through H of FIG. 17 and which are explained in further detail below. As will become apparent, door assembly 88 is primarily connected to what would constitute the inner side of arch assembly 12 when it is raised to its erected position, and accordingly to assist in making the various assemblies and connections at ground level, work stands or hydraulic jacks 95 may be utilized to hold or retain the lower surfaces of arch assembly 12 off the ground.

Detail A of FIG. 17 as shown in FIG. 18 relates to the connection of arch beam member 94 to the joint of beam members 21 and 23 of beam assembly 12. The same assembly details as set forth above relative to FIG. 3*a* are applicable hereto except that the hollow pins 26 from FIG. 3*a* are replaced by longer hollow pins 96 which are preferably threaded at the ends thereof and threaded nuts 97 threadedly mounted on the ends of hollow pins 96. Also, the interconnection between adjacent beam members 94 is the same as that shown for assembly of adjacent beam members 21 and 23 in FIG. 18 and the assembly of adjacent beam members of arch assembly 12 as shown in FIG. 3*a*.

FIG. 19 relates to the details of circle B of FIG. 17, and shows the details of the connection of support column 89 to the joint of two adjacent beam members 23 of arch assembly 12 and the joint of two adjacent beam members 94 when such are included for structural support purposes. Support column 89 is located on the inner side of arch assembly 12 by a threaded pin 96 passing through the holes of beam members 23 and 94 that is the farthest away from the pivotal connection of beam assembly 12 to the end base rail 14 or 15, with nuts 97 mounted on the ends of pin 96. Pin 26 is located through the corresponding holes of beam members 23 and 94 that is closet to the pivotal connection or arch assembly 12 to base rail members 14 or 15, with retainer clips 27 retaining pin 26 in place. Pin 26 also attaches a fabric attach retainer flange or key strip 98 whose longitudinal end is shaped to form a J or U shaped flange 99 to which a correspondingly shaped flange or key strip is connected along the edge of the door fabric 93 in that portion of door assembly 88 extending from support column 89 outwardly to the base rail assembly 11. The flange or key strip 98 extends from the joint shown in FIG. 19 to the next outward joint of arch assembly 12 which is the joint connection between a standard beam 23 and end beam 21, and another strip 98 is mounted to end beam 21 as seen in FIG. 31.

The details of circle C of FIG. 17 are shown in FIG. 20 whereby a pivot door column 90 is pivotally connected to one of the pins 96 used to form the joint between adjacent beams members 23 or arch assembly 12 and support beams 94; it being noted pivot door column 90 is located preferably on the interior side of arch assembly 12.

FIG. 21 shows the details of circle D of FIG. 17, and depicts the attachment of the end of the trolley beam 92 to the joint of two adjacent beam members 23 of arch assembly 12 and the intermost end of the structural support of arch beam members 94 if such are utilized. The roller door column 91 has roller devices 100 mounted at the upper end thereof located within the channel 101 of trolley beam 92, the roller 100 riding on surfaces 102 thereby permitting the roller columns to move laterally in their opening and closing operation. As can be seen in FIG. 17, the trolley beam 92 is of a substantially straight elongation with the upper surface 103 of the end thereof in FIG. 21 deflected or made arcuate to permit passage of panels 13 over the ends of trolley beam 92 since trolley beam 92 is preferably mounted on the interior of arch beam assembly 12. Also, it is to be noted here that references are made continuously throughout the description of this invention to pins 26 incorporating grooves 28 for retainer clips 27 and pins 96 being threaded for engagement therewith by threaded nuts 97, and that such references to pins 26 and 96 are made notwithstanding the fact that various lengths of pins will be utilized and/or necessary for the assembly of components as described herein without distinction as to the differences or variations in the length of pins 26 and 96. Likewise, it is to be recognized that while most of the pins 26 and 96 may be hollow, there may be occasions when there is sufficient structural load so as to require solid pins.

FIG. 22 depicts the details of circle E of FIG. 17 and shows one embodiment for enclosing the vertical gap between trolley beam 92 and arch assembly 12 which is occasioned by trolley beam 92 running linearly from its points of connection to arch assembly 12 while assembly 12 continues an arcute extension between the points of connection of trolley beam 92. Such gap or opening is closed by a thin metal strap member 104 secured to an appropriately configured piece of door fabric or canvas 105 of the same material as door fabric or canvas 93; strap 104 connected to beam 22 of arch assembly 12 by pin 96. Strap 104 and fabric 105 may be further secured to the bottom side of beam 22 by an L bolt 106 having a right angle attachment 107 secured thereto for engagement with one of the lower right angle corners of beam 22 and retained in place by wing nut 108 threadedly connected to bolt 106. The lower end of fabric member or piece 105 is appropriately connected to and between a strap 109 and a right angle member 110 with member 110 located and resting on the upper surface of trolley beam 92 and strap 109 extending down along the side of trolley beam 92 for retention thereagainst by a ball lock pin 20 extending through trolley beam 92. Intermediate hanger support for the trolley beam 92, if desired or necessary, may be accomplished by an appropriate strap member 111 connected to beam 22 by pin 96 with the other end in turn connected to trolley beam 92 through ball lock pin 20. Door fabric 93 is connected to the roller door columns 91 through hanger plates 112 appropriately secured to the fabric and a hook 113 on hanger place 112 inserted through a hanger eye 114 that is secured to roller door column 91. Eyelet 115 is also shown mounted to hanger plate 112 which is used for rigging of cable for opening and closing of door assembly 88 as described below.

As shown in FIG. 17, the columns 89, 90, and 91 may be preferred to be segmented due to the size of the door assembly 88 and/or the size of shipping containers for transportation of the erectable components. Thusly, in FIG. 23 one arrangement for connecting a pair of column members 116 and 117 adapted to be telescopically fitted together and retained in asssembled relationship through a ball lock pin 20 passing through aligned openings in column members 116 and 117; FIG. 23 representing the details of circle F of FIG. 17, and which can be a joint in columns 89, 90, and/or 91.

When door assembly 88 is closed, and since all of the columns 89, 90, and 91 are connected at their upper ends directly to arch assembly 12 of the trolley beam 92, it may in turn be desired to secure the bottom ends of columns 89, 90, and 91 for a more secure retention of the door assembly 88 in a closed position. When such retention of the bottoms of columns 90 and 91 are desired, the preferred embodiment is an arrangement shown in FIG. 24 which represents the detail of circle G of FIG. 17 and comprises a ground plate member 118 of an inverted U-shaped channel having a plurality of elongated slots or openings 119 through the upper surface thereof. Ground plate member 118 may have its side flanges partially or almost wholly embedded in the ground with a ground cable 120 extending substantially the distance between end rail assemblies 11 as best clearly seen in FIG. 17. Ground cable 120 can be either connected at each end to a ground rail assembly 11 or staked to the ground in an appropriate manner such that ground cable 120 is loose enough to be pulled upwardly through one of the slots or openings 119 and placed in a slot 121 of the end of column 91. Upon seating of the portion of ground cable 120 looping deflected through the slot 119 to the base of slot 121, column 91 can become connected to ground cable 120 by the insertion of ball lock pin 20 through the holes in the end of column 91.

Thusly, to ready door assembly 88 for opening, disconnection between columns 90 and 91 with ground cable 120 is accomplished quite easily by merely removing the appropriate ball lock pins 20, release of the ground cable 120 from slots 121 and the columns 90 and 91 are then free to move relative to ground plates 118.

Since the support columns 89 are not movable due to the fixed connection of the upper ends of support columns 89 to arch assembly 12, the ends of support columns 89 may be secured to appropriate ground plate members 122 of FIG. 25 (and which constitutes details of circle H of FIG. 17) by which the ends of column 89 can be secured thereto by a ball lock pin 20 passing through the aligned holes of clevis 123 and 124 as shown.

The opening and closure of door assembly 88 is accomplished by a cable and winch arrangement with the cables attached or connected to appropriate door column members which will now be described. With specific reference to FIGS. 26 and 31, a winch assembly 125 is mounted to the inside of the ends or arch assembly 12 having a primary winch 126 on which is mounted a primary cable 127. Winch assemblies 125 also contain a winch 128 consisting of a double drum on which are mounted a pair of secondary cables 129 and 130 which are wrapped around the drum of winch 128 in opposite directions so that as secondary cable 129 winds up on the drum of winch 128, secondary cable 130 is unwound from the drum, and vice versa as winch 128 is operated to wind secondary cable 130 onto the drum, secondary cable 129 is unwound therefrom.

Now referring specifically to FIGS. 26, 27, and 28, primary cable 127 extends from winch 126 of winch assembly 125 up to and over a roller 131 mounted on a shaft 132 that is inserted through appropriate holes at the upper end of support column 89 and retained in place by a ball lock pin 133 as best seen in FIG. 27. Primary cable 127 then passes through appropriate slots in pivot columns 90 and roller columns 91 in a manner depicted in FIG. 26 and uponpassing through the slot 134 in the centermost roller column 91 for each half of door assembly 88 as shown in FIG. 28, cable 127 is connected by placement of a washer type retainer device 135 over an eye end 136 on cable 127 and a ball lock pin 137 is inserted through the eye 136 so that the end of cable 127 cannot be withdrawn through passage 134 toward winch 126.

It is to be noted in FIGS. 26 and 27 that primary cable 127 is located outside of the fabric door material 93 so that roller 131 is physically located between support column 89 and the door fabric hanger plate 112; the hanger plate 112 in turn being connected by the hanger plate hook 113 engaging a slot **113*a* in the upper end of support column 89, which in turn is connected to the arch assembly 12 shown in phantom in FIG. 27** in a manner described above.

It is also to be noted that there is a similar winch assembly 125 with another primary cable 125 extending therefrom located on the other end of the end arch assembly 12 for control and operation of the other half of door assembly 88 which is not shown in FIG. 26. The secondary cables 129 and 130 extend from winch 128 through an eyelet 115 located in holes 138 in each hanger plate 112 and connected thereto by a threaded nut (it being noted here that eyelet 115 has been omitted from FIG. 27 for clarity purposes). As shown in FIG. 29, the hanger plates 112 containing eyelet 115 are hung from the hanger eye 114 on both of the pivotal door columns 90 and the roller door column 91 adjacent to the pivotal door columns 90.

Figure 30:
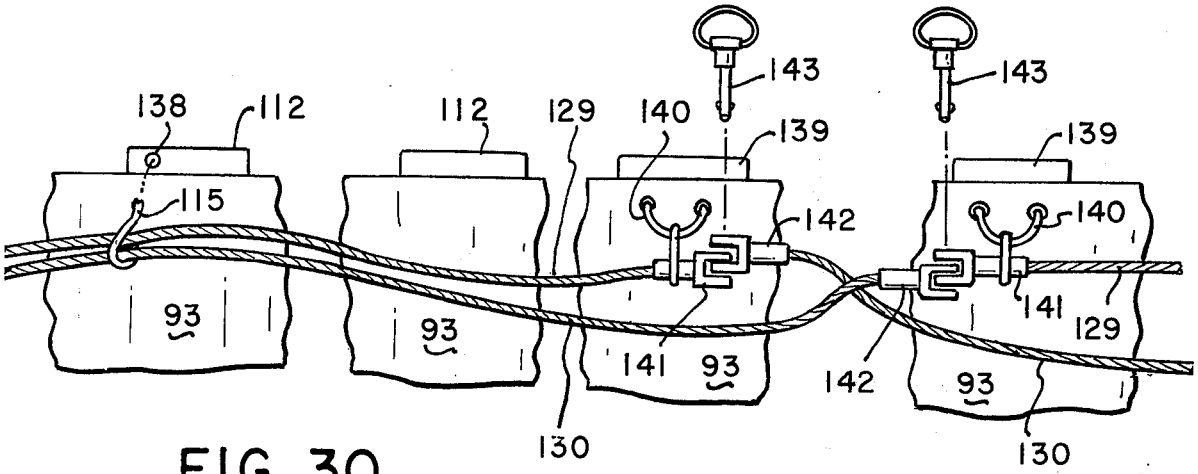

As shown in FIG. 30, the hanger plates 139 that go on the roller column at the center of each door half has an eye member 140 to which is securely clamped an end clevis fitting 141 that is in turn secured to the end of secondary cable 129 extending from each winch 128 on winch assemblies 125. The ends of both of the other secondary cables 130 each have a corresponding end clevis fitting 142 secured to the cable ends and completion of the door opening and closing rigging is accomplished by ball lock pins 143 connecting the end fitting 141 of secondary cable 129 from one winch 128 to the end fitting 142 of the secondary cable 130 coming from the other winch 128 at the other side of the door assembly.

In this manner, opening of the door when it is closed and secured is accomplished by release of the columns 90 and 91 from the ground cable 120 as depicted in FIG. 24 followed by appropriate actuation of the winches 128 of FIG. 31 so that the secondary cables 129 of FIG. 30 are placed in tension whereby the adjacent roller columns 91 in the center of the door are moved away from each other, the winding of secondary cables 129 on winches 128 in turn unwinding the respective cables 130 to follow the end of cable 129 from the other winch 128 as can be seen in FIG. 30. Such operation of winches 128 continues until the three roller column members are located next to their respective ends of trolley beam 92. During this Operation the slack appearing in cable 126 can be taken up by corresponding operation of winches 126. Upon completion of the roller beam columns 91 movement on the trolley beam 92, further opening of the door is accomplished by operation of winches 126 whereby the bottom or ground ends of roller columns 90 and pivotal columns 91 swing in an arc upwardly and outwardly toward their respective end rail assemblies 11 until further door opening is precluded by the support columns 89. Closure of the door assembly 88 can be accomplished by reversal of the opening operation.

It is to be noted here that throughout the previous description, the various references to hand-operated winches, i.e., winches 50 for erection of arch assemblies 112, winch 72 for installation and removals of panels 13, and winches 126 and 128 for door operation may be all or selectively replaced or substituted for by powered winches of a mechanical, hydraulic, electrical or pneumatic power operation.

In the case where the end closure is not desired to be openable, the door assembly as shown may be utilized in which the door opening rigging may be omitted, and the adjacent center door columns from each half may be connected together in any appropriate manner.

In FIGS. 32 through 38, there is shown an arrangement for one embodiment of a side entry door that is fully compatible with the objects of this invention of having an entire erectable shelter that can be assembled and erected from ground level from standard-like prefabricated components. The embodiment of the side entry door shown is compatible with all the components heretofore described and can be located between any two adjacent beam assemblies 12 throughout the longitudinal extent of base rail assemblies 11.

Figure 33:
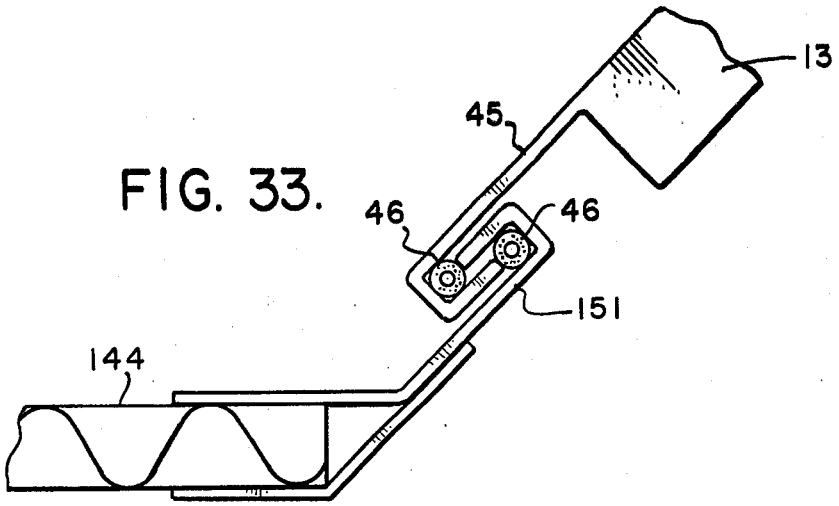
Figure 34:
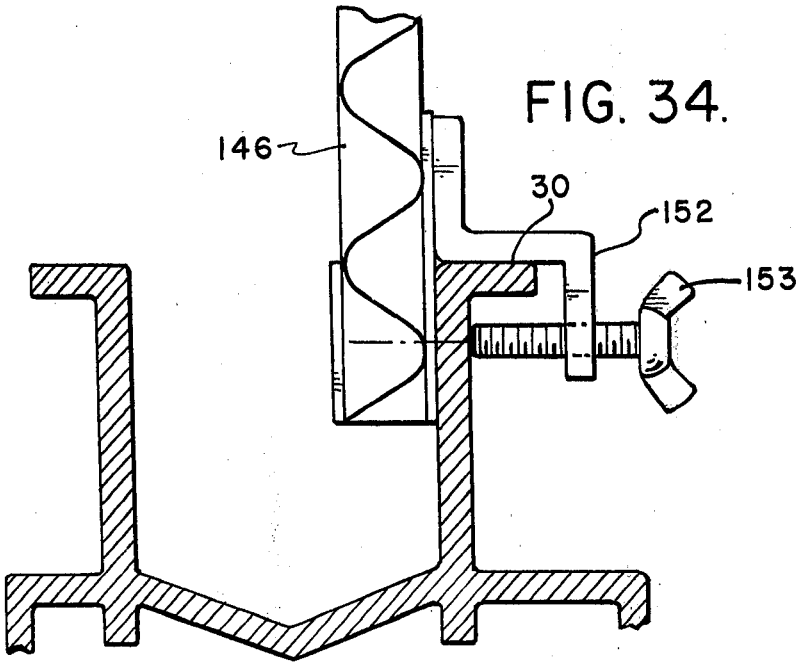

The side door entry door structure comprises roof panel 144, side panels 145 and 146, front panels 147 and 148, and a door 149 pivotally connected to the front panel 148 by hinge 150. In FIG. 33, roof panel 144 has a longitudinal edge 151 engageable with the longitudinal edge 45 of the endmost installed panel 13 of the arch the side entry door is being mounted on, with edges 45 and 151 both containing seal members 46 and when appropriately engaged will constitute a weather-proof seal. In FIG. 34, side panel 146 is shown having a plurality of clamp members 152 mounted to the inner side of panel 146 in such a position as to contact the upper surface of flange 30 and a lateral projection that extends below the lower surface of flange 30. A thumb screw 153 engages a threaded hole in clamp member 152 which when turned down will have the end of screw 153 in contact with the upright base for flange 30 extending from an arch beam. An appropriate number of clamping arrangements as shown in FIG. 34 are located along the curved edge of side panels 145 and 146 in the manner shown.

Figure 35:
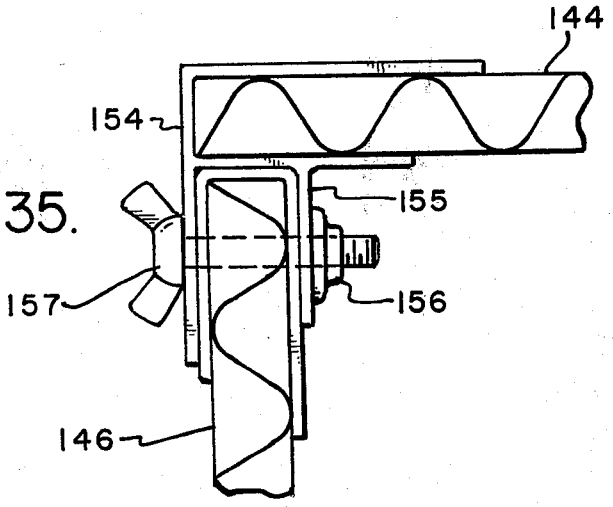

Connections of the roof panels to the side panels are shown in FIG. 35 wherein the side ends of roof panel 144 are shaped to provide a U channel having an outer wall 154 and an inner wall 155. A floating nut mount 156 is secured to the outer surface of inner wall 155 with holes in the outer and inner walls 154 and 155 respectively and side panel 146 for a thumb screw 157 to extend therethrough and make threaded engagement with floating nut 156.

FIG. 36 shows the front door panel 147 mounted by a thumb screw 158 passing through the edging of panel 147 into a nut plate 159 mounted on bracket 160 mounted to the side of side panel 145. To avoid deflection or damage to the L-shape of the bracket 160, an appropriate gusset 161 may be incorporated.

FIG. 37 shows the attachment of the front door panels 147 and 148 to roof panel 144 in which a flange or wall 162 extends downwardly from the bottom surface of roof panel 144 against which the end of front door panel 148 is abutted on one side thereof, and a clamp member 163, threadedly connected to a thumb screw 164 passing through door panel 148 may be manually rotated upwardly to abut the opposite side of flange 162 so that flange 162 becomes clamped between clamp member 163 and the side of panel 148 upon the turning down of the thumb screw 164.

FIG. 38 shows a connection for the front door panels to the base rail assemblies 11 which consists of a J-bolt 165 engaged with the innermost downward flange of the base rail assembly 11 and extending upwardly and outwardly over the upper surface of the base rail assembly 11 to pass through a hole and end flange appropriately located on front panel 148; the assembly held in place by a wing nut 166 mounted on the threaded end of J-bolt 165.

The various side entry door panels may be constructed of corrugated metallic or plastic structure, a honeycomb type panel, or any other appropriate or desired panel construction having equivalent edging attachments to thos shown and described above.

As indicated previously, the novel features of the erectable structure disclosed herein may be utilized for merely an overhead protection type shelter without end closure doors or members, the same as the inclusion of a side entry door is optional. In order to maintain the panel-to-panel interlocking seal throughout one entire arch of panels, it is preferred not to place more than one side entry door for each arch of panels since to do so would preclude the ability to provide any tension in the arch or panels as shown in FIG. 16. Likewise, it is to be recognized that the shelter 10 described above may be utilized with appropriate end closure and side entry doors other than those embodiments shown and described herein; and that some of the panels 13 may be configured to include windows, exhaust fan exists, chimney exists, or whatever.

While particular embodiments of the invention has been illustrated and described, it will be obvious to those skilled in the art that various changes and modifications may be made without departing from the invention and it is intended to cover in the appended claims all such modifications and equivalents as fall within the true spirit and scope of this invention.

What is claimed is:

1. A shelter or building assembly that may be both erected and disassembled for relocation and erection elsewhere with all assembly, erection and disassembly accomplished without elevation of any personnel from the base level of a location site comprising in combination:

a pair of elongated base rail means located longitudinally coextensive and equidistant laterally spaced from each other at the location site;

a plurality of arch beam means each having a linear distance between the ends thereof substantially equal to the lateral spacing between the pair of base rail means;

connection means consisting of first members mounted and spaced along said base rail means and second members on the ends of said arch beam means, said first and second members adapted for pivotal connection together by a pin means on axes substantially perpendicular to the longitudinal elongation of said base rail means and substantially parallel to the planes defined by said arch beam means whereby the ends of said arch beam means may be connected to said base rail means while an arch beam means is substantially parallel to the location site surface before pivotal raising of the arch beam means to an erected position;

each pair of adjacent arch beam means when located in their erected positions forming an arch frame between the pair of base rail means, and a plurality of individual panel means each adapted to slidably and retainably engage each of a pair of adjacent arch beam means and to sealingly engage with adjacent panel means in the same arch frame, the plurality of panel means when installed in each said arch frame constituting inclement weather-sealed arch frame shelter covers and the only means for retaining said arch beam means pivotally connected to said base rail means in their upright erected positions.

2. An assembly as claimed in claim 1 wherein said base rail means comprises a plurality of segments each having at least one end adapted to be pivotally connected to another segment to constitute adjacent elongated segments forming at least a part of said base rail means;

and means pivotally connecting each adjacent pair of segments such that the axis of the pivotal connection is perpendicular to and maintains the longitudinal elongation of the segments when connected together.

3. An assembly as claimed in claim 2 wherein each adjacent segment connection is located intermediate a pair of adjacent first members of said connection means mounted on said base rail means.

4. An assembly as claimed in claim 2 wherein each said intermediate segment of the base rail means located between the end segments has only one of said first members of said connection means mounted thereon.

5. An assembly as claimed in claim 4 wherein the location of said first member of said connection means mounted on said intermediate segment is proximate the longitudinal midpoint of said segment.

6. An assembly as claimed in claim 1 wherein each arch beam means comprises an assembly of a plurality of beam segments each fixedly joined to an adjacent beam segment.

7. An assembly as claimed in claim 6 wherein the joints of adjacent beam segments include a portion of one beam segment telescoped into the other beam segment.

8. An assembly as claimed in claim 7 wherein the beam segment joints include at least two pins extending laterally through aligned holes in the telescoping portions of the two beam segments.

9. An assembly as claimed in claim 8 wherein at least one of said pins is hollow.

10. An assembly as claimed in claim 7 wherein the arch beam means assembly comprises two end beam segments, a center beam segment, and at least one standard beam segment between the center beam segment and each end beam segment, each end of the center beam segment telescoping into an adjacent standard beam segment to form joints, and each end beam segment having an end of a standard beam segment telescoped therein to form a joint.

11. An assembly as claimed in claim 1 wherein each arch beam means includes a pair of arcuate track flanges extending upwardly from the arch beam means when in its erected position, each of said flanges adapted to receive the slidable and retainable engagement of one end of said panel means extending from one of said arch beam means to an adjacent arch beam means in formation of said arch frame shelter cover.

12. An assembly as claimed in claim 11 wherein said pair of arcuate track flanges are laterally spaced to provide the side walls of a channel means extending the length of said flanges, said channel means constituting a passage for gravity runoff to ground level of any inclement weather water entering the channel means.

13. An assembly as claimed in claim 12 wherein the arch beam means transverse cross-section defines an enclosed hollow interior which extends substantially the length of the arch beam means, said track flanges extending upwardly from the upper portion of the enclosed hollow interior so that said upper portion in turn constitutes the bottom of said channel means, a plurality of passages through said upper portion whereby runoff water may pass from the channel means to the enclosed hollow interior of said arch beam means, and at least one opening proximate each end of said arch beam means through which runoff water flowing in the enclosed hollow interior of the arch beam means may exit.

14. An assembly as claimed in claim 11 wherein the ends of said panel means engaging the arcuate track flanges of the arch beam means are channeled to provide passages for said track flanges as the panel means slidably engage said track flanges.

15. An assembly as claimed in claim 14 wherein said track flange passage channels proximate each end thereof includes a lug member projecting laterally into the channel from one sidewall of the channel, and at least one cutout of sufficient length in each arcuate track flange to permit said lug member to pass through a portion of the track flange for retention of the panel means end after some sliding of the panel means on the arcuate track flanges of both of an adjacent pair of arch beam means, said cutouts located proximate the ends of said arch beam means whereby said panels can only be slidably and retainably connected to said arch beam means at said cutouts and which are readily accessible from ground level of the location site.

16. An assembly as claimed in claim 15 wherein said panel means are of an overall flat configuration, the depth of said track flange passage channels is at least equal to the arcuate vertical height of the portion of the arch beam means arcuate track flanges the panel means will extend over without deflection of the panel means from its flat configuration, and the track flange passage channel portions confronting said lug members being arcuately configured in approximately the same degree of curvature of the arcuate track flanges.

17. An assembly as claimed in claim 1 wherein the sealing engagement between adjacent panel means in each arch frame comprises a longitudinal edge member on the first panel means of a J cross-sectional configuration to form an open sided channel, a corresponding longitudinal edge member on the second panel means and rotated 180° about the longitudinal axis relative to the longitudinal edge member of said first panel means, and a seal means located longitudinally along the bottom of at least one of said channels whereby when the first and second panel means have their longitudinal edge members interengaged and tensioned away from each other, the edge of the shorter channel sidewall of one panel means longitudinal edge is in sealing contact with the seal means in the longitudinal edge channel of the other panel means.

18. An assembly as claimed in claim 1 wherein each arch beam means includes a pair of arcuate track flanges extending upwardly from the arch beam means when in its erected position;

said pair of arcuate track flanges laterally spaced to provide the side walls of a channel means extending the length of said flanges, said channel means constituting a passage for gravity runoff to ground level of any inclement weather water entering directly and from installed panels engaged with said arch beam means; each of said flanges adapted to receive the slidable and retainable engagement of one end of said panels extending from said arch beam means to an adjacent arch beam means in formation of said arch frame shelter cover;

the ends of said panel means engaging the arcuate track flanges of the arch beam means are channeled to provide passage for said track flanges as the panel means slidably engage said track flanges, said track flange passage channels proximate each end thereof including a lug member projecting laterally into the channel from one sidewall of the channel, and at least one cutout of sufficient length in each arcuate track flange to permit said lug member to pass through a portion of the track flange for retention of the panel means end after some sliding of the panel means on the arcuate track flanges of both of an adjacent pair of arch beam means, said cutouts located proximate the ends of said arch beam means whereby said panels can only be slidably and retainably connected to said arch beam means at said cutouts and which are readily accessible from ground level of the location site;

the sealing engagement between adjacent panel means in each arch frame comprising a longitudinal edge member on the first panel means of a J cross-sectional configuration to form an open sided channel, a corresponding longitudinal edge member on the second panel means and rotated 180° about the longitudinal axis relative to the longitudinal edge member of said first panel means;

and a seal means located longitudinally along the bottom of at least one of said channels whereby when the first and second panel means have their longitudinal edge members interengaged and tensioned away from each other, the edge of the shorter channel sidewall of one panel means longitudinal edge is in a sealing contact with the seal means in the longitudinal edge channel of the other panel means.

19. An assembly as claimed in claim 1 including an end closure means connected to at least one of the arch beam means having only one other adjacent means to form an arch frame with.

20. An assembly as claimed in claim 19 wherein said end closure means comprises a pair of fabric structures, each said fabric structure constituting one half of said end closure means and containing at least two vertical column structures when the arch beam means said end closure means is connected to is in its erected position, the first vertical column structure comprising a support column securely connected to the arch beam means intermediate the span of the fabric structure, the second vertical column structure comprising at least one pivot column pivotally connected to the arch beam means, the end most pivot column of each fabric structure being adjacent each other to form a center seam for said end closure means, and a ground plate means connectable to the ground ends of said vertical columns when the arch beam means the end closure means is connected to is in its erected position.

21. An assembly as claimed in claim 20 wherein a cable means is connected to said pivot column in the bottom half thereof and extends to a winch proximate the connection of the arch beam means to the base rail means for each half of said end closure means whereby said end closure means is openable by the winding of the cable means on their respective winches so that the bottom of the pivot columns each swing outwardly and upwardly about the pivotal connections of the pivot columns to the arch beam means until further movement of the pivot columns is prevented by the stationary support columns.

22. An assembly as claimed in claim 20 wherein said end closure means further includes a trolley beam means spanning the upper center portion of the arch beam means, at least a third vertical column structure for each fabric structure comprising a roller column connected to said trolley beam in a manner that the roller column may roll longitudinally thereof and pivotally thereto, said roller columns being intermediate the pivot columns of both fabric structures, a first cable means connected to said roller column in the bottom half extends to a first winch proximate the connection of the arch beam means to the base rail means for each half of said end closure means, and a second cable means connected to said roller column in the upper half extends to a second winch proximate the connection of the arch beam means to the base rail means for each half of said end closure means, the second cable means for each fabric structure interconnected intermediate their respective connections to said roller columns whereby said end closure means is openable by operation of the respective second cable means to cause lateral separation of the respective roller columns of each half as they travel longitudinally along their respective portions of the trolley beam to the ends thereof followed by appropriate winding of the first cable means on their respective winches so that the bottoms of the roller and pivot columns for each half swing outwardly and upwardly about the roller connections of the roller columns to the trolley beam and the pivotal connections of the pivot columns to the arch beam means until further movement of the roller and pivot columns is prevented by the respective support column.

23. An assembly as claimed in claim 1 including a side entry door means comprising a roof member, a pair of side members, at least one front member, and a door member;

said roof member having one longitudinal edge adapted to sealingly engage with the edge of the last panel means in the arch frame the side entry door means will be mounted to;

said side members having one edge conforming to an outer surface of an arch beam means, and being of a vertical dimension to bridge the distance between said base rail means and said roof member when engaged to the arch frame panel means;

said front and door members having substantially corresponding vertical dimensions as said side members to bridge the distance between the roof member and the base rail means, said door member being pivotally connected to said at least one front member along said vertical dimension;

and various means for effecting connections between the side members to the arch beam means, roof member, and front member, and the front member to the roof member and base rail means.

24. The method of constructing a building or shelter assembly at a site whereby all assembly and erection is accomplished by all personnel remaining at ground level and with a minimum of site preparation comprising the steps of:

laying out a pair of elongated base rail means in longitudinal coextension with equidistant lateral spacing on the site so that each base rail means has a proximate end and a distal end relative to at least one ground located A-frame;

laying out a first arch beam means having a linear distance between its ends substantially corresponding to the lateral spacing of the base rail means so that the ends of the arch beam means are located near said proximate ends of the base rail means and the center of said arch beam means is closer to said base rail means distal ends than the arch beam means ends;

pivotally connecting each end of the arch beam means to one of the base rail means;

extending a cable from a winch on the A-frame through a passage in the arch beam means and engaging the cable with the arch beam means so that upon winding of the cable onto the winch, the arch beam means can be erected into an upright position while the cable can be further extended by travel through the arch beam means cable passage after the arch beam means is upright and retained and the cable is unwound from the winch;

winching the first arch beam means to an upright position;

retaining the erected first arch beam means to the A-frame;

laying out a second arch beam means and pivotally connecting it to the base rail means in the same manner as for the first arch beam means with said second arch beam means pivotal connections spaced from the first pivotal connections;

extending the cable from the A-frame winch through the cable passage in the first arch beam means to the second arch beam means and engaging it therewith;

winching the second arch beam means to an upright position to form an arch frame after placing a removable spacing means over the cable between the first and second arch beam means to prevent said second arch beam from movement beyond its upright position;

placing the first of a plurality of panel means adapted to slidably and retainably engage the first and second arch beam means and span the distance therebetween into engagement with the first and second arch beam means at a location reachable from ground level;

sliding the first panel means upwardly to make room for a second panel means and placing the second panel means into engagement with the first and second arch beam means as with the first panel means but after engaging the confronting edges of the first and second panel means which are adapted to sealingly engage with each other;

continuing installation of additional panel means in the same manner as for the second panel means until the arch frame is substantially filled with said panel means so that after removal of the spacing means and first arch beam means retention to the A-frame, the only means retaining the arch beam means pivotally connected to the base rail means in their upright erected position are the installed panel means.

25. The method as claimed in claim 24 including the step of assembling each base rail means from a plurality of components.

26. The method as claimed in claim 24 including the step of assembling each arch beam means from a plurality of components.

27. The method as claimed in claim 24 including the step of connecting an end closure means to the first arch beam means after its pivotal connections to said base rail means and before erection to an upright position.

28. The method as claimed in claim 24 including the steps of laying out, assembling and connecting an openable end closure means to the first arch beam means after its pivotal connections to said base rail means, and laying out, assembling and connecting a door opening cable rigging system and components to the end closure means and the first arch beam means after the arch beam means is pivotally connected to said base rail means, all of the additional steps recited herein occurring prior to the base rail means being erected to an upright position.

* * * * *